US007404739B2

(12) United States Patent
Sheilds et al.

(10) Patent No.: US 7,404,739 B2
(45) Date of Patent: Jul. 29, 2008

(54) ELECTRICAL CONNECTOR WITH ENHANCED JACK INTERFACE

(75) Inventors: Linda Ellen Sheilds, Camp Hill, PA (US); Sam Denovich, Harrisburg, PA (US); James Joseph Eberle, Jr., Hummelstown, PA (US); Ralph Sykes Martin, Mount Airy, NC (US); Michael Patrick Green, Mechanicsburg, PA (US); Paul John Pepe, Clemmons, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/707,612

(22) Filed: Feb. 15, 2007

(65) Prior Publication Data

US 2007/0141908 A1 Jun. 21, 2007

Related U.S. Application Data

(63) Continuation-in-part of application No. 11/119,858, filed on May 2, 2005, now Pat. No. 7,195,518.

(51) Int. Cl.
*H01R 13/648* (2006.01)

(52) U.S. Cl. ..... 439/608; 439/290

(58) Field of Classification Search ..... 439/608, 439/610, 290, 392, 680, 417
See application file for complete search history.

(56) References Cited

U.S. PATENT DOCUMENTS 5,074,804 A 12/1991 Pantland et al.
5,175,928 A * 1/1993 Grabbe ..... 29/884
5,234,358 A 8/1993 Polgar
5,599,202 A 2/1997 Key
5,697,806 A 12/1997 Whiteman, Jr. et al.
5,791,943 A 8/1998 Lo et al.
5,885,111 A 3/1999 Yu
5,895,292 A 4/1999 Affeltranger
5,989,071 A 11/1999 Larsen et al.
6,010,353 A 1/2000 Ensz et al.
6,056,586 A 5/2000 Lin
6,077,122 A 6/2000 Elkhatib et al.
6,129,586 A 10/2000 Bellemon
6,135,822 A * 10/2000 Hwang ..... 439/680
6,267,617 B1 7/2001 Nozick
6,283,792 B1 * 9/2001 Tolmie et al. ..... 439/608
6,287,149 B1 9/2001 Elkhatib et al.
6,592,396 B2 7/2003 Pepe et al.
6,629,858 B2 10/2003 Lo et al.
6,702,617 B1 3/2004 Clement et al.
6,716,054 B1 4/2004 Denovich et al.
RE38,519 E 5/2004 Doorhy et al.

(Continued)

FOREIGN PATENT DOCUMENTS

EP 1137119 9/2001

*Primary Examiner*—Hae Moon Hyeon

(57) ABSTRACT

A connector includes a housing having a mating end, a wire receiving end and a longitudinal axis therethrough. The housing holds a plurality of contacts grouped in pairs and arranged about the axis. At least one shielding member is located within the housing. The at least one shielding member isolates each contact pair from an adjacent contact pair. An organizer is configured for attachment to the wire receiving end of the housing. The organizer defines a central opening that receives a plurality of signal wires. The organizer includes a plurality of wire guides arranged about the central opening. Each wire guide receives one of the signal wires.

20 Claims, 18 Drawing Sheets

U.S. PATENT DOCUMENTS 6,758,695 B2 7/2004 Pepe et al.
6,780,054 B2 8/2004 Yip et al.
6,830,488 B2 12/2004 Bush et al.
6,910,897 B2 6/2005 Driscoll et al.
6,953,362 B2 10/2005 Mossner et al.
7,195,518 B2 3/2007 Bert et al.

* cited by examiner

ELECTRICAL CONNECTOR WITH ENHANCED JACK INTERFACE

CROSS REFERENCE TO RELATED APPLICATIONS

This application is a continuation-in-part of U.S. application Ser. No. 11/119,858, filed May 2, 2005, now U.S. Pat. No. 7,195,518 and entitled "Electrical Connector With Enhanced Jack Interface", which is hereby incorporated by reference in its entirety.

BACKGROUND OF THE INVENTION

The invention relates generally to electrical connectors, and more particularly, to a connector that minimizes crosstalk among signal conductors in the connector, minimizes return loss in a pair of signal conductors in the connector, and minimizes alien cross talk from signal conductors in neighboring connectors.

In electrical systems, there is increasing concern for preserving signal integrity as signal speed and bandwidth increase. One source of signal degradation is crosstalk between multiple signal paths. In the case of an electrical connector carrying multiple signals, crosstalk occurs when signals conducted over a first signal path are partly transferred by inductive or capacitive coupling into a second signal path. The transferred signals produce crosstalk in the second path that degrades the signal routed over the second path.

For example, a typical industry standard type RJ-45 communication connector includes four pairs of conductors defining different signal paths. The RJ-45 plug design is dictated by industry standards and is inherently susceptible to crosstalk. In conventional RJ-45 plug and jack connectors, all four pairs of conductors extend closely parallel to one another over a length of the connector body. One pair of conductors is also split around another conductor pair. Thus, signal crosstalk may be induced between and among different pairs of connector conductors. The amplitude of the crosstalk, or the degree of signal degradation, generally increases as the frequency increases. More crosstalk can be created by the contacts in the jack that interface with the contacts in the plug. As signal speed and density increase, alien crosstalk, or crosstalk between neighboring connectors must also be addressed in preserving signal integrity.

At least some RJ-45 jacks include features that are intended to suppress or compensate for crosstalk. The shortcomings that are inherent in jacks such as the RJ-45 can be expected to become more serious as system demands continue to increase. It would be desirable to develop a connector that is designed to minimize both internal crosstalk and alien crosstalk at the outset rather than to correct for crosstalk after the fact.

Another source of signal degradation is return loss resulting from signal reflections along the conductors. Return loss can originate from multiple sources such as variations in impedance among the various elements in the connector as well as along the signal path. Improving return loss performance has proven to be difficult.

BRIEF DESCRIPTION OF THE INVENTION

In one embodiment, an electrical connector is provided. The connector includes a housing having a mating end, a wire receiving end and a longitudinal axis therethrough. The housing holds a plurality of contacts grouped in pairs and arranged about the axis. At least one shielding member is located within the housing. The at least one shielding member isolates each contact pair from an adjacent contact pair. An organizer is configured for attachment to the wire receiving end of the housing. The organizer defines a central opening that receives a plurality of signal wires. The organizer includes a plurality of wire guides arranged about the central opening. Each wire guide receives one of the signal wires.

Optionally, The housing includes interior side walls and the housing and interior side walls are fabricated from a conductive material. The at least one shielding member comprises a conductive interior wall of the housing. The wire guides are arranged in first and second rows on opposite sides of the central opening. Each wire guide includes a wire dress opening configured to receive a terminating end of a respective one of the contacts to terminate the contact to a respective wire when the organizer is attached to the housing. The organizer includes a slot sized to receive a rearward end of the interior wall such that pairs of wire guides are shielded from adjacent pairs of wire guides. Each contact pair is held in a dielectric insert having a first contact beam guide located in a first plane and a second contact beam guide located in a second plane different from the first plane such that beam portions of the contacts of the contact pair are stepped with respect to one another.

In another embodiment, a connector assembly is provided. The connector assembly includes a connector assembly including a first connector including a housing having a mating end and a wire receiving end. The housing has at least one compartment holding a pair of contacts. At least one shielding member is located within the housing. The at least one shielding member isolates the contact pair from an adjacent contact pair. An organizer is configured for attachment to the wire receiving end of the housing. The organizer defines a central opening that receives a plurality of signal wires. The organizer includes a plurality of wire guides arranged about the central opening. Each wire guides receives one of the signal wires. A second connector is matable with the first connector. The second connector includes a dielectric plug housing having a plug guide holding a pair of mating contacts. The plug guide is configured to be received in the at least one compartment. The at least one shielding member shields the plug guide from an adjacent plug guide when the second connector is mated to the first connector.

DETAILED DESCRIPTION OF THE INVENTION

Figure 1:
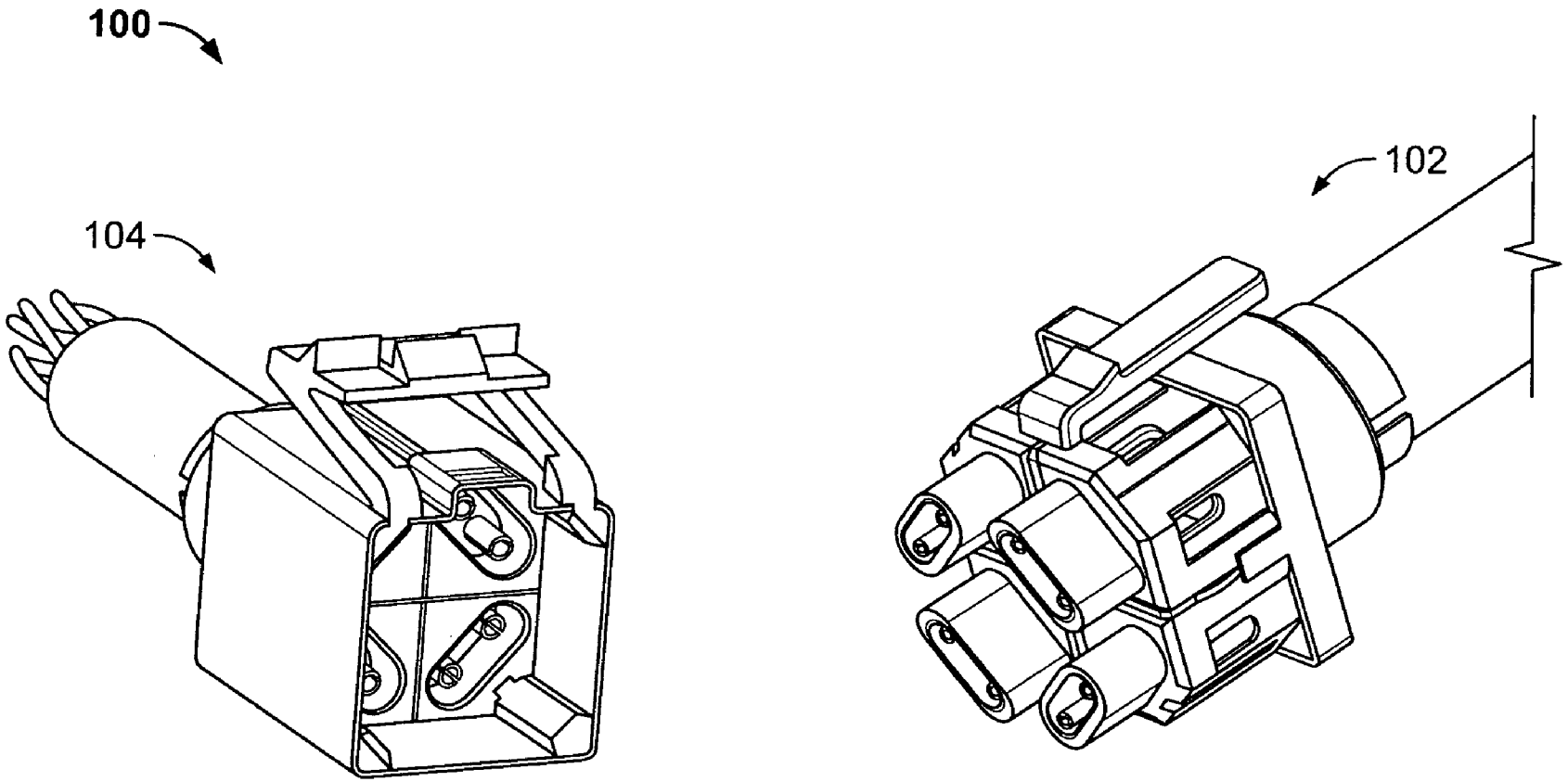
FIG. 1 is a perspective view of a connector assembly formed in accordance with an exemplary embodiment of the present invention.

FIG. 1 is a perspective view of a connector assembly 100 formed in accordance with an exemplary embodiment of the present invention. The assembly 100 includes a plug 102 and a jack 104 that are configured to mate with one another. The jack 104 may be mounted on a wall or panel, or, alternatively, may be mounted in an electrical device or apparatus having a communications port through which the device may communicate with other external networked devices. The assembly 100 will be described in terms of an assembly carrying four differential signal pairs. However, it is to be understood that the benefits described herein are also applicable to other connectors carrying fewer or greater numbers of signal pairs in alternative embodiments. The following description is therefore provided for illustrative purposes only and is but one potential application of the inventive concepts herein.

Figure 2:
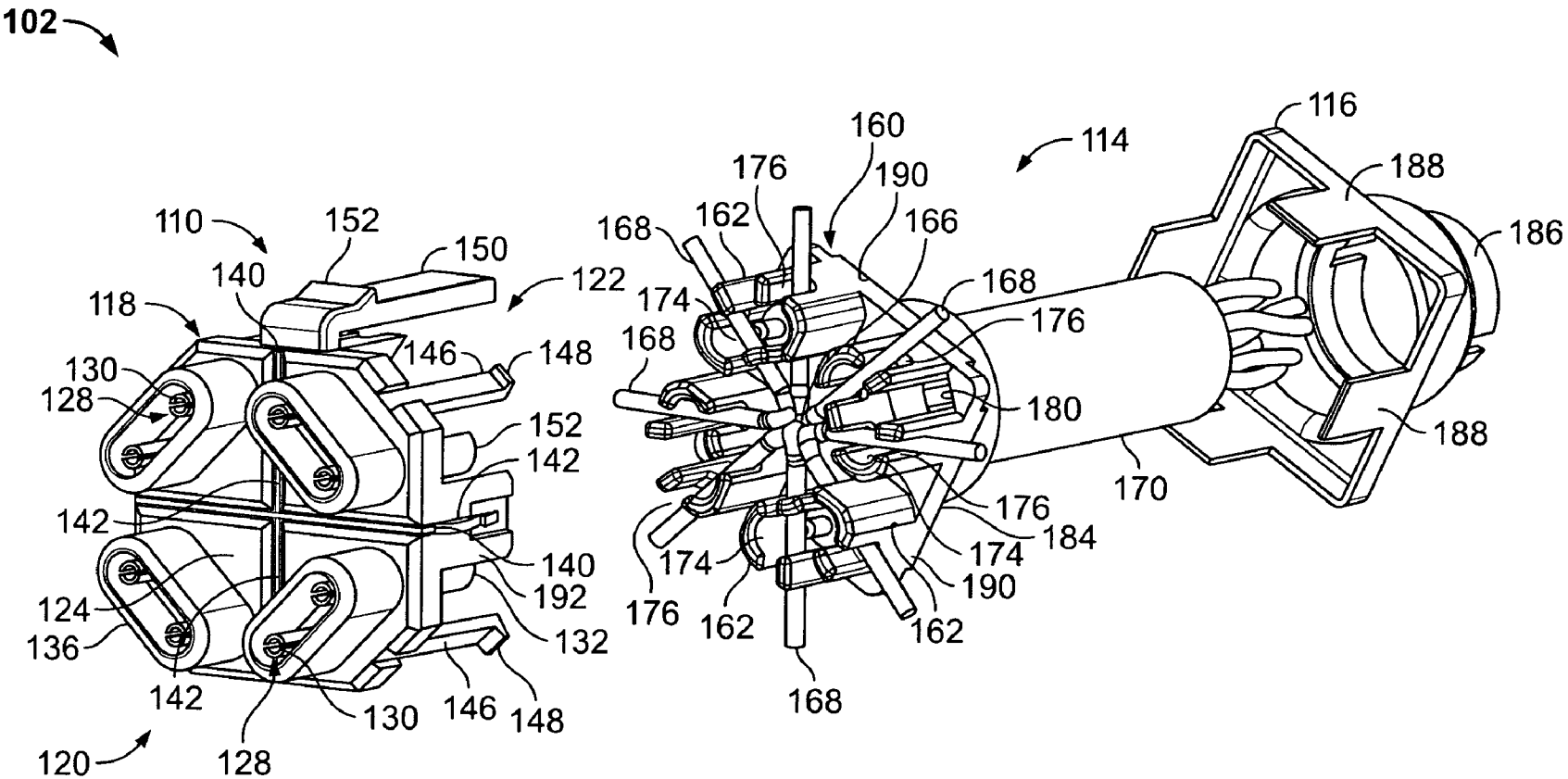
FIG. 2 is an exploded view of the plug connector shown in FIG. 1.

FIG. 2 illustrates an exploded view of the plug 102. The plug 102 includes a housing 110, an organizer 114, and a cap 116. The housing 110 has a body 118 that has a mating end 120 and a wire receiving end 122. The body 118 is fabricated from a dielectric material and includes a base 124 that holds a plurality of electrical contacts 128. Each contact 128 extends through the base 124 and has a mating end 130 proximate the mating end 120 of the body 118 and a wire terminating end 132 proximate the wire receiving end 122 of the body 118. The contacts 128 are arranged in differential pairs with the mating ends 130 of each differential pair surrounded by a shroud 136.

The connector assembly 100 is designed to have a characteristic impedance through the connector assembly 100. Impedance, or more specifically, variations in impedance along a signal path through the connector assembly 100, is a factor in the return loss of a connector assembly 100. The impedance of the connector assembly 100, and thus the return loss therein, is determined by factors such as the dielectric properties of the housing material, and particularly the material between contacts of a signal pair, the spacing between the contacts of a differential pair, the geometry of the contacts, e.g., diameter or cross section, and shield proximity, among others. Known dielectric materials include foamed polyethylene, natural polyethylene, natural polypropylene, foamed flouropolymers, natural flouropolymers, natural rubber, ceramics, glass, FR-4 printed circuit board material, and air, as well as others. In an exemplary embodiment, the connector assembly 100 has a characteristic impedance of 100 ohms and includes a mixture of natural polyethylene and air in the dielectric material, a spacing of 0.135 inches between contacts of a signal pair, 0.07 inch nominal contact diameter, and a 0.145 inch nominal distance from the signal contact pair to the shield. As known to one skilled in the art, other combinations of the different factors may also meet the requirements. In other embodiments, different impedance values may be employed. Known simulation software may be used to optimize design variables for particular design goals.

A pair of intersecting slots 140 is formed in and extends across the base 124. In the illustrated embodiment, the slots 140 divide the body into four sections, each of which holds a pair of contacts 128 that are a differential signal pair. Shielding members 142 are provided in the slots 140 to isolate the differential contact pairs from one another thereby reducing crosstalk between the differential pairs. The shielding members 142 are fabricated from a conductive material such as metal or metallized plastic, or the like. In an exemplary embodiment, the shielding members 142 are metal plates. Latch arms 146, only two of which are visible in FIG. 2, extend from the body 118 rearwardly toward the wire receiving end 122 of the body 118. A latch element 148 is formed at the end of each latch arm 146. The latch arms 146 are provided to lock the housing 110 and organizer 114 together. A connector latch lever 150 is provided that includes a latch member 152 for latching the plug 102 to the jack 104 as will be described.

The organizer 114 includes a backing plate 160 and a plurality of wire guides 162 extending therefrom. In one embodiment, the wire guides 162 are formed integrally with the backing plate 160. The wire guides 162 are arranged in pairs and are distributed about a central opening 166 in the backing plate 160. The central opening 166 receives signal wires 168 for termination with the wire terminating ends 132 of the contacts 128. The signal wires are carried in a cable 170. Each wire guide 162 includes an opening or hole 174 that is centrally positioned and extends downwardly toward the backing plate 160. A wire dress slot 176 extends across each hole 174. The wire dress slots 176 extend to a depth that is less than the depth of the holes 174. Each wire dress slot 176 receives one of the signal wires 168. Each pair of wires 168 are twisted at a certain rate within the cable 170. The organizer 114 is designed to minimize untwisting of the signal wires 168 so as to minimize the introduction of any undesired electrical properties in the connector 102.

The wire guides 162 organize and arrange the signal wires 168 radially about the central opening 166 in preparation for termination with the contacts 128. In an exemplary embodiment, the contacts 128 are symmetrically arranged within the housing about a longitudinal axis A (FIG. 3) which is an axis of symmetry of the housing 110. For example, in one embodiment, the contacts 128 are circumferentially arranged about the axis A; however, as known to one skilled in the art, the contacts 128 may be used in any number of arrangements. The central opening 166 in the backing plate has a center (not shown) that is located substantially in line with the axis A of the housing 110 such that each of the wire guides 162 is positioned to align with one of the contacts 128. With the organizer 114, the signal wires 168 are arranged in a radial pattern wherein the differential signal pairs are grouped together and spaced apart or separated. The spacing is chosen to enhance return loss performance. The signal wires 168 are also laid out to be substantially equal in length when terminated within the housing 110 so as to equalize signal paths within the plug 102 to prevent skew in the plug 102. The signal wires 168 are terminated to the contacts 128 when the organizer 114 is attached to the housing 110.

The backing plate 160 includes openings 180 that receive the latch elements 148 from the latch arms 146. In the embodiment shown in FIG. 2, the backing plate 160 is substantially square and includes an opening 180 proximate each corner. Only one of the openings 180 is visible in FIG. 2. When the housing 110 and the organizer 114 are joined, the wire terminating ends 132 of the contacts 128 are received in the holes 174 of the wire guides 162 and the latch elements 148 are received through the openings 180 and latch against a rearward side 184 of the backing plate 160 with snap-fit engagement to lock the housing 110 and the organizer 114 together. The cap 116 includes a collar 186 that receives the cable 170. Tabs 188 on the cap 116 frictionally engage side edges 190 of the backing plate 160 and sides 192 of the body 118 to secure the cable 170 to the organizer 114. The cap 116 is fabricated from a metal or metallized material. The tabs 188 also engage the edges of the shielding members 142 to electrically connect to the shielding members 142. The cable 170 includes a cable shield (not shown) which is folded back over the cable when the cable is inserted into the organizer. A crimp connection is formed at the collar 186 to provide electrical connection between the cable shield and the cap 116. The cap 116 also provides shielding for the rear of the plug 102 to reduce alien crosstalk between the connector and other electrical devices. The cap 116 also electrically connects the plug shield members 142 to the jack shield 214 (FIG. 4) when the jack 104 (FIG. 1) and plug 102 are mated.

Figure 3:
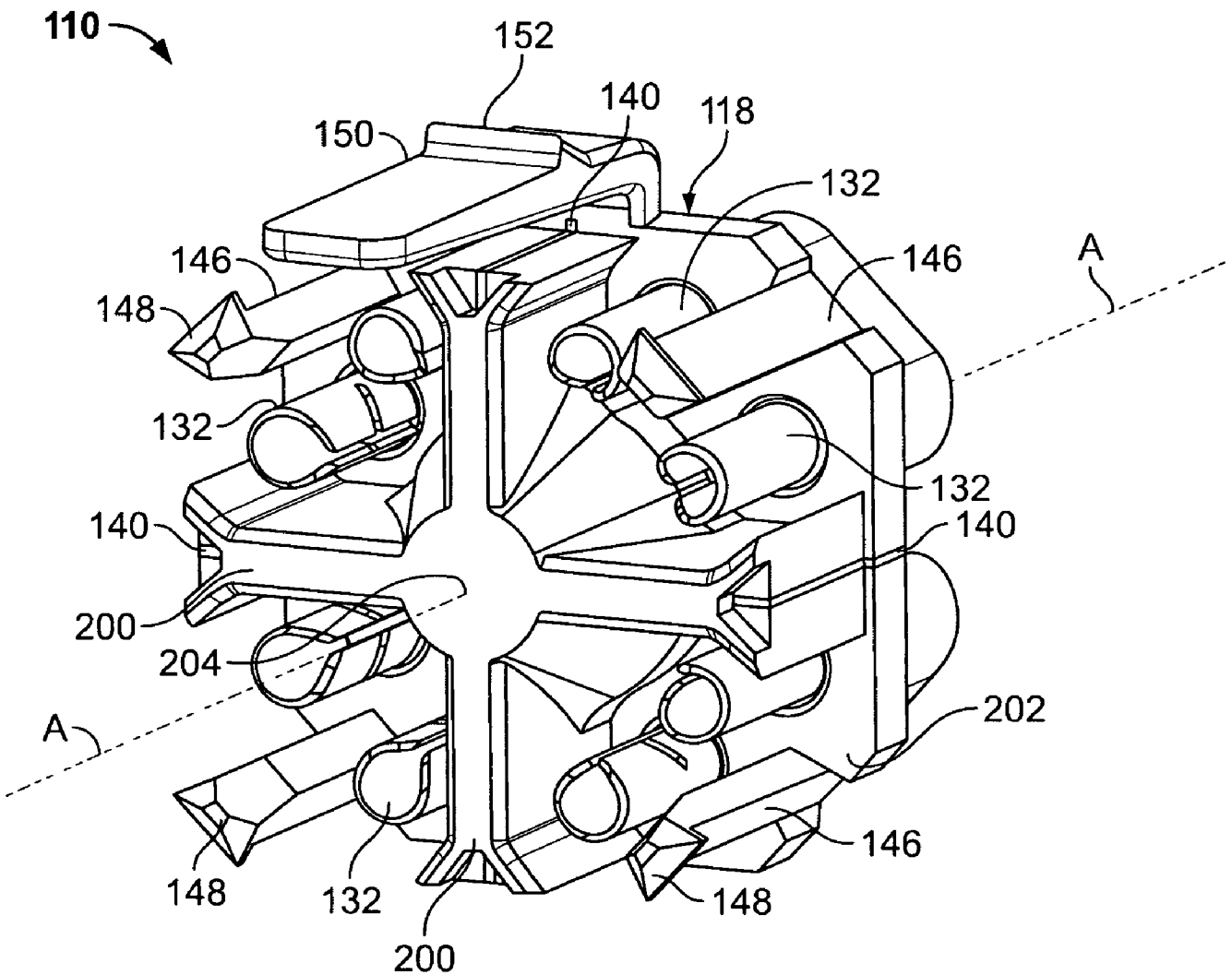
FIG. 3 is a rear perspective view of the plug housing shown in FIG. 2.

FIG. 3 illustrates a rear perspective view of the plug housing 110. Intersecting webs 200 extend rearwardly from a back side 202 of the base 124. The slots 140 extend through the base 124 and into the webs 200. The slots 140 do not extend completely through the webs 200 so that the shield plates 142 (FIG. 2) are retained in the webs 200. The housing 110 has a longitudinal axis A that is an axis of symmetry through a center 204 of the housing 110 (without the latch lever 150). The terminating ends 132 of the contacts 128 are arranged around the axis A and the webs 200 separate differential contact pairs from one another. In an exemplary embodiment, the terminating ends 132 of the contacts 128 are arranged circumferentially around the axis A. Moreover, when shielding members 142 (FIG. 2) are placed in the slots 140, the differential contact pairs are shielded from one another to reduce or eliminate crosstalk between the differential contact pairs.

Figure 4:
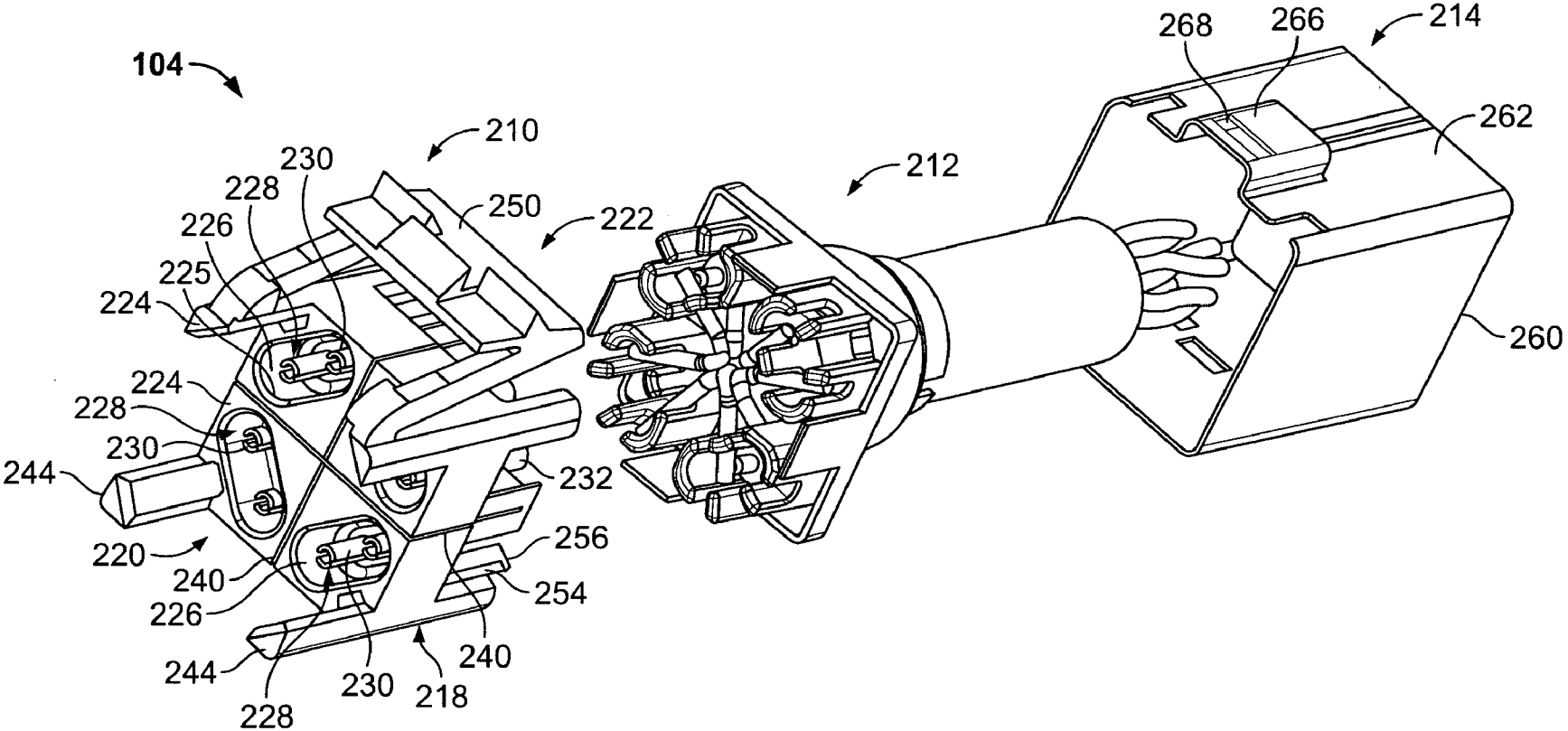
FIG. 4 is an exploded view of the jack connector shown in FIG. 1.

FIG. 4 illustrates an exploded view of the jack 104. The jack 104 includes a housing 210, an organizer 212, and an exterior shield 214. The housing 210 has a body 218 that has a mating end 220 and a wire receiving end 222. The body 218 is fabricated from one or more dielectric materials and includes a base 224. Interior walls 225 define a plurality of compartments or wells 226, each of which holds a pair of electrical contacts 228. Each contact 228 extends through the base 224 and has a mating end 230 proximate the mating end 220 of the body 218 and a wire terminating end 232 proximate the wire receiving end 222 of the body 218. The contacts 228 are arranged in differential pairs. The wells 226 are complementary in shape to the shrouds 136 on the plug housing 110 (FIG. 2) and are configured to receive the shrouds 136 when the plug 102 and jack 104 are mated with one another. A pair of intersecting slots 240 is formed in and extends across the base 224. In the illustrated embodiment, the slots 240 divide the body into four sections, each of which holds a pair of contacts 228 that are a differential pair. Shielding members (not shown) are provided in the slots 240 to isolate the differential contact pairs from one another thereby reducing crosstalk between the differential pairs. The shielding members are fabricated from a conductive material such as metal or metallized plastic, or the like.

The housing body 218 includes posts 244 that forwardly extend from the base 224. The posts 244 act as guides that receive the plug 102 to align the plug 102 (FIG. 1) for mating with the jack 104. A mounting latch 250 is pivotably joined to forward ends of two adjacent posts 244. The mounting latch 250 is provided to facilitate mounting the jack 104 in a panel, faceplate, chassis, or electrical box and the like. The body 218 also includes a plurality of latch arms 254 that rearwardly extend from the body 218 toward the wire receiving end 222 of the body 218. A latch element 256 is formed at the end of each latch arm 254. The latch arms 254 are provided to lock the housing 210 and organizer 212 together. Only one latch arm 254 is visible in FIG. 4. However, four latch arms 254 and their corresponding latch elements 256 are visible in FIG. 5. The organizer 212 is identical to the organizer 114 and will not be separately described.

The exterior shield 214 is provided to enclose the assembled housing 210 and organizer 212 as shown in FIG. 1. The external shield 214 isolates the plug 102 (FIG. 1) and jack 104, when mated, from noise from neighboring connectors (not shown), cables, or other external sources. The exterior shield provides an electrical path, such as a ground path for the shielding within the plug 102 and jack 104. The external shield 214 cooperates with the internal shielding provided by the shielding members in the plug 102 and jack 104 to minimize signal degradation due to alien crosstalk and other external sources of noise. In an exemplary embodiment, the external shield is fabricated from a conductive metal material. Other materials such as metallized plastic may be used in other embodiments. Furthermore, as described previously, in some embodiments, shielded cable is also employed.

The external shield 214 includes a hollow body 260 that is generally box shaped. The body 260 has an upper surface 262 that is aligned with the mounting latch 250 on the jack housing 210 to orient the jack housing 210 in the external shield 214. The upper surface 262 includes a raised channel 266 that is configured to receive the latch lever 150 on the plug housing 110 (FIG. 2). In this manner, the plug 102 (FIG. 1) is aligned with the jack 104 when the plug 102 and jack 104 are mated. The channel 266 includes an opening 268 that receives the latch member 152 on the latch lever 150 to inhibit separation of the plug 102 from the jack 104 once mated. When it is desired to unmate the plug 102 and jack 104, the latch lever 150 is depressed to release the latch member 152 from the opening 268 after which withdrawal of the latch lever 150 from the channel 266 is permitted as well as separation of the plug 102 from the jack 104.

Figure 5:
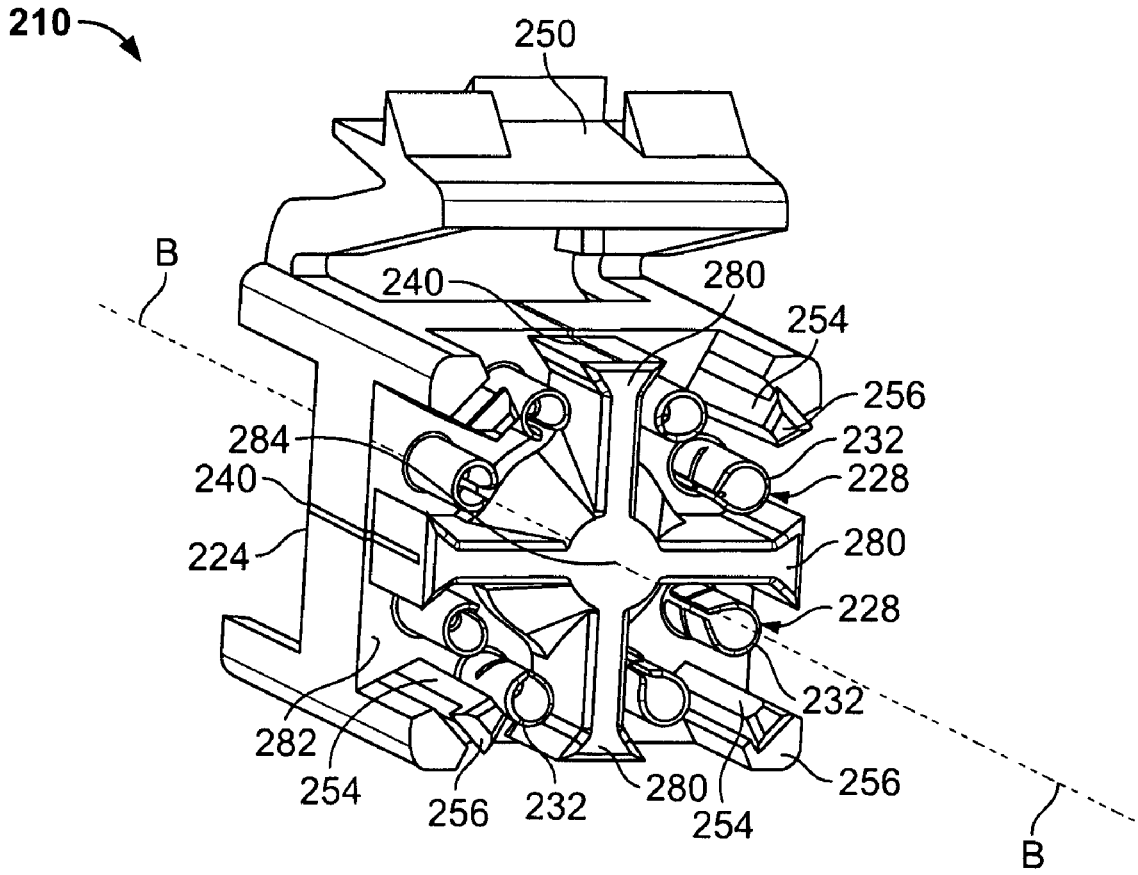
FIG. 5 is a rear perspective view of the jack housing shown in FIG. 4.

FIG. 5 illustrates a rear perspective view of the jack housing 210. Intersecting webs 280 extend rearwardly from a back side 282 of the base 224. The slots 240 are formed in the webs 280. The slots 240 do not extend completely through the webs 280 so that the shield plates are retained in the webs 280. The housing 210 has a longitudinal axis B that, without regard to the mounting latch 250, is an axis of symmetry through a center 284 of the housing 210. The contacts 228 are arranged around the axis B and the webs 280 separate differential contact pairs from one another. In an exemplary embodiment, the terminating ends 132 of the contacts 228 are arranged circumferentially around the axis B. In other embodiments, however, other arrangements of the terminating ends 132 may be employed. Moreover, when shielding members (not shown) are placed in the slots 240, the differential contact pairs are shielded from one another to reduce or eliminate crosstalk between the differential contact pairs.

Figure 6:
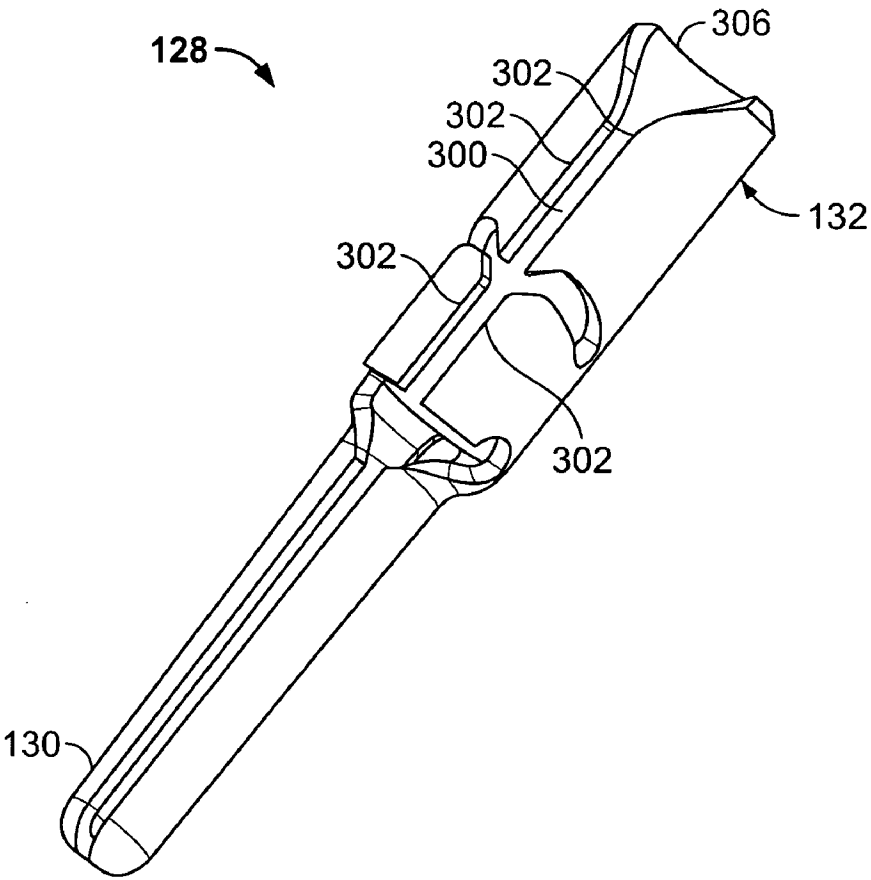
FIG. 6 is a perspective view of a pin contact formed in accordance with an exemplary embodiment of the present invention.

FIG. 6 illustrates a perspective view of a contact 128 used in the plug 102 (FIG. 2). The mating end 130 of the contact 128 is a pin contact. The opposite wire terminating end 132 is a barrel type insulation displacement contact (IDC). The wire terminating end 132 includes a wire receiving slot 300 that is formed between insulation cutting edges 302. A wire cutting edge 306 is formed at an open end of the wire terminating end 132. When the organizer 114 is joined with the plug housing 110, the wire terminating ends 132 of the contacts 128 are received in the holes 174 (FIG. 2) in the wire guides 162. The insulation cutting edges 302 cut through the insulation on the signal wires 168 (FIG. 2) terminating the wires to the contacts 128 to establish electrical connections therewith. Simultaneously, the wire cutting edges 306 cut off the excess length of the signal wires 168.

Figure 7:
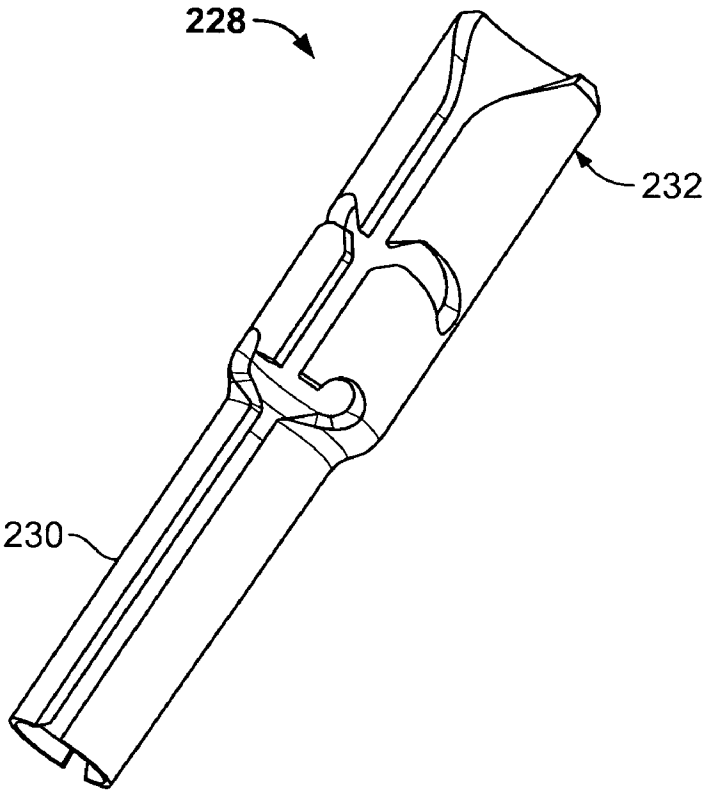
FIG. 7 is a perspective view of a socket contact formed in accordance with an exemplary embodiment of the present invention.

FIG. 7 illustrates a perspective view of a contact 228 used in the jack 104 (FIG. 4). The mating end 230 of the contact 228 is a socket contact that is configured to receive the pin portion or mating end 130 of the plug contact 128. In other respects, the contact 228 is identical to the contact 128 described above with the same wire terminating features. The pin and socket connection between the plug 102 (FIG. 2) and jack 104 provides a more reliable connection than, for instance, a known blade and spring connection found in standard RJ-45 connectors.

Figure 8:
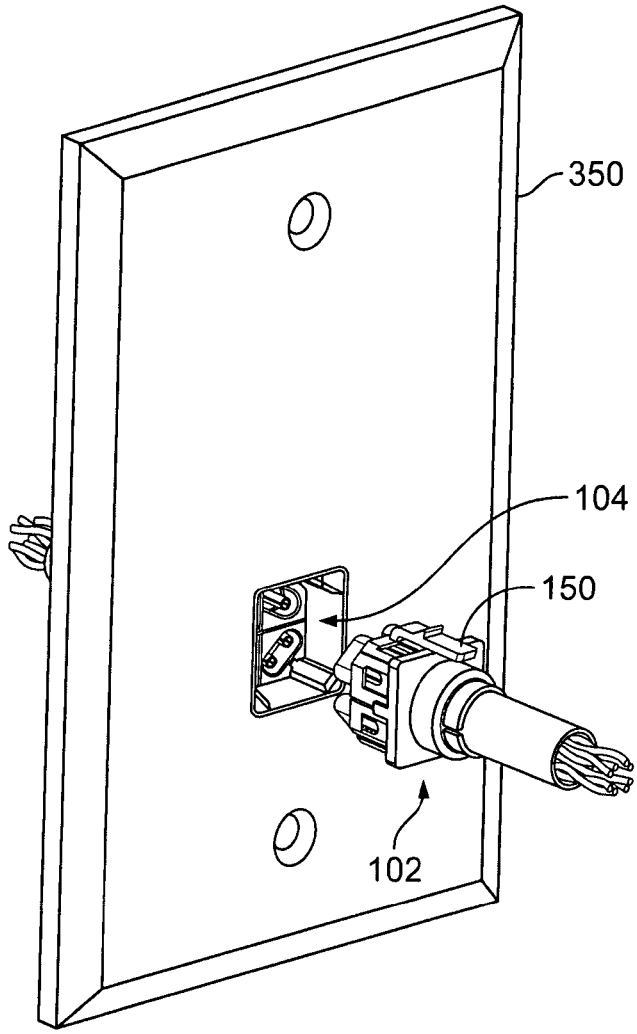
FIG. 8 is a perspective view of the connector assembly shown in FIG. 1 used in a wall mount installation.

FIG. 8 illustrates a wall mount installation of the connector assembly 100. In FIG. 8, the jack 104 is mounted in a wall (not shown) as is common for telecommunications connections. Access to the jack 104 is made available through a face plate 350. Mating and unmating of the plug 102 and jack 104 is as previously described through the operation of the latch lever 150.

Figure 9:
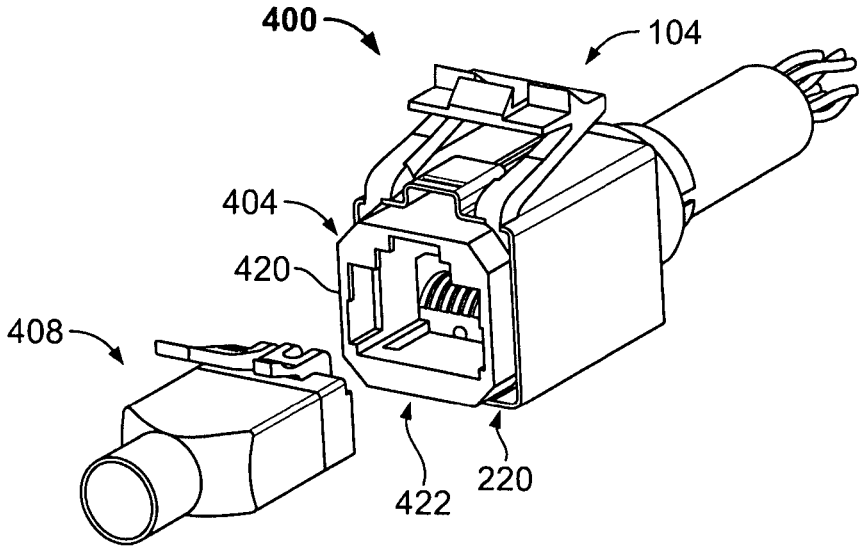
FIG. 9 is a perspective view of a connector assembly including an interface adapter formed in accordance with an exemplary embodiment of the present invention.

FIG. 9 illustrates a perspective view a connector assembly 400 that includes a jack 104, an adapter 404, and a plug connector 408. The adapter 404 provides an interface that allows a plug, other than the plug 102 to be mated with the jack 104. In an exemplary embodiment, the plug connector 408 is a standard RJ-45 plug. In other embodiments, the adapter 404 may be configured to accept other plug connectors having configurations different from an RJ-45. The adapter 404 is received in the mating end 220 of the jack 104. The adapter 404 includes a housing 420 that itself includes an interface end 422 that receives the plug connector 408.

Figure 10:
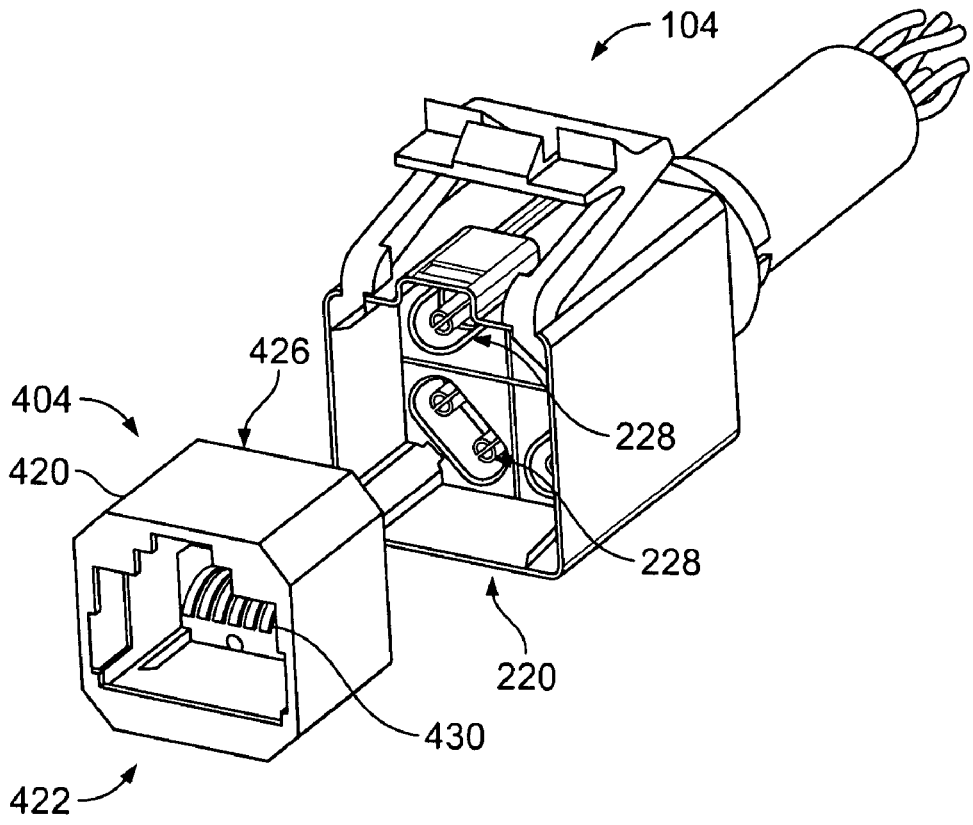
FIG. 10 is a front exploded view of the adapter and jack shown in FIG. 9.

FIG. 10 is a front exploded view showing the adapter 404 separated from the jack 104. The housing 420 of the adapter 404 includes a mating end 426 opposite the interface end 422. The mating end 426 is received in the mating end 220 of the jack 104. The adapter 404 includes contacts 430 that are complementary to contacts (not shown) in the plug connector 108 (FIG. 9). In an exemplary embodiment, the contacts 430 are spring contacts that are configured to mate with an RJ-45 plug.

Figure 11:
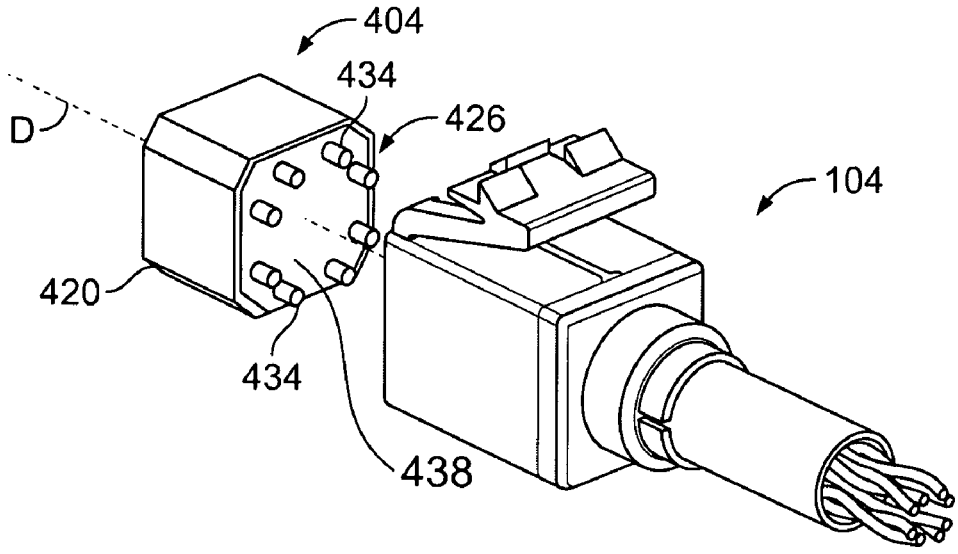
FIG. 11 is a rear exploded view of the adapter and jack shown in FIG. 10.

FIG. 11 is a rear exploded view of the adapter 404 separated from the jack 104. Terminal contacts 434 extend from a rear wall 438 at the mating end 426 and are configured to mate with the contacts 228 (FIG. 10) in the jack 104. In an exemplary embodiment, the rear wall 438 may be a printed circuit board. The contacts 430 (FIG. 10) at the interface end 422 of the adapter 404 are electrically connected to the terminal contacts 434 within the adapter 404. The contacts 430 and the terminal contacts 434 may be unitarily formed or may be separately formed and electrically connected to each other through electrical traces in a printed circuit board or by other known methods. Moreover, the adapter 404 may include active components such as power devices, processors, capacitive devices, inductive devices, LED's, and the like that may alter the electrical signal.

The terminal contacts 434 are positioned in an arrangement or pattern that is complementary to the contact pattern in the jack 104 thereby enabling the plug connector 408 (FIG. 9) to be interfaced with the jack 104. The arrangement of the terminal contacts may correspond or may differ from the arrangement of the contacts 430 at the interface end 422 of the adapter housing 420. In one embodiment, the terminal contacts are arranged about a centerline D through the adapter 404. Multiple embodiments of the adapter 404 are contemplated that include different patterns between contacts, such as the contacts 430 at the interface end 422 of the adapter 404, and terminal contacts 434 at the mating end 426 of the adapter 404 that are complementary with the contact patterns of different plug connectors. Furthermore, while the adapter has been described as having an interface end and a mating end, or rather, an interface on each side, in alternative embodiments, the adapter may have an interface on one side and an end device, such as a display, a wireless access point, or a sensor, and the like at the other side.

Figure 12:
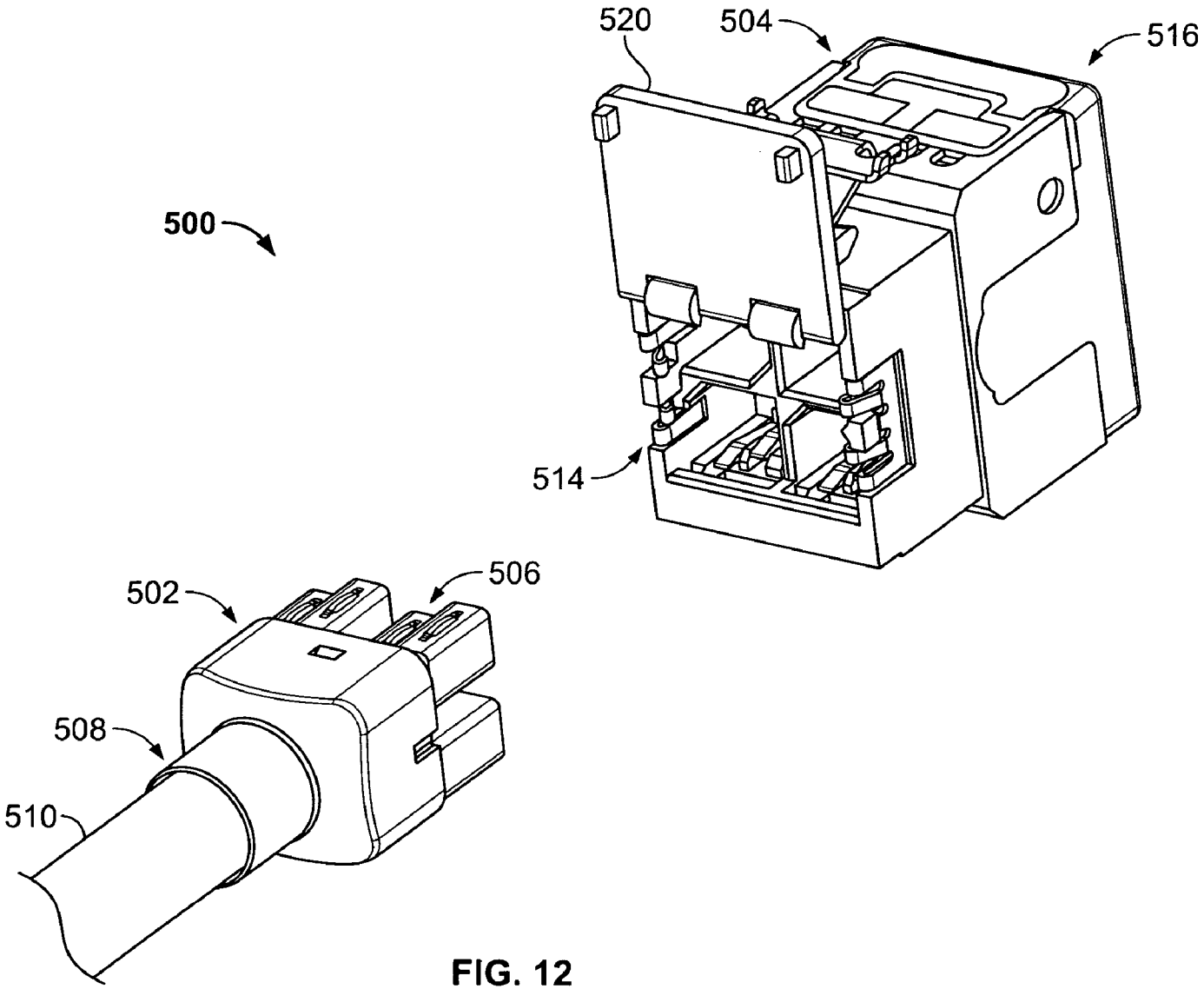
FIG. 12 is a perspective view of a connector assembly formed in accordance with an alternative embodiment of the present invention.

FIG. 12 illustrates a perspective view of a connector assembly 500 formed in accordance with an alternative embodiment of the present invention. The assembly 500 includes a plug 502 and a jack 504 that are configured to mate with one another. As with the assembly 100 previously described, the jack 504 may be mounted on a wall or panel, and is particularly adapted to data center applications. The assembly 500 is configured to interconnect multiple pairs of conductors carrying differential signals. For purposes of illustration only, in the description that follows, the assembly 500 will be described in terms of a plug 502 and jack 504 carrying four differential signal pairs. It is to be understood that no limitation is intended. Further, the jack 504 as shown may be used with plugs having one pair, two pair, or four signal wire pairs, as shown.

The plug 502 includes a mating end 506 configured to mate with the jack 504, and a wire receiving end 508 that is configured to receive a cable 510 that includes multiple conductors or wires. The jack 504 has a mating end 514 and a wire receiving end 516. The mating end 514 of the jack 504 is configured to receive the mating end 506 of the plug 502. The wire receiving end 516 receives a multiple wire cable such as the cable 510. The jack 504 is provided with a dust cover 520 that covers the mating end 514 of the jack 504 when the jack 504 is not in use.

Figure 13:
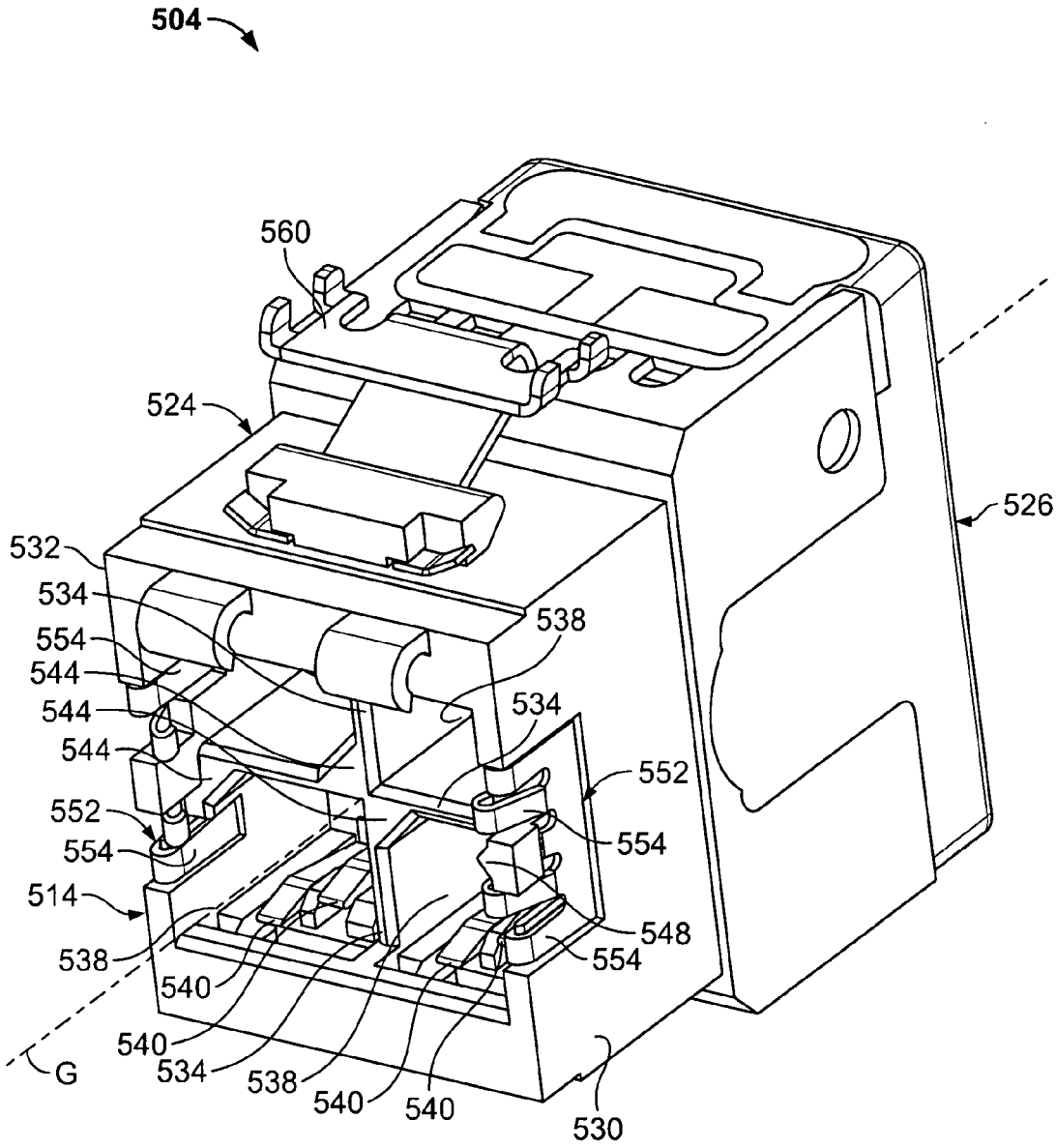
FIG. 13 is a front perspective view of the jack shown in FIG. 12.

FIG. 13 illustrates a front perspective view of the jack 504 with the dust cover 520 removed. The jack 504 includes a housing 524 and an end cap 526 both of which are fabricated from a conductive material to thereby shield the interior of the jack 504. In an exemplary embodiment, the housing 524 and end cap 526 are fabricated from die cast metal. The housing 524 extends along a longitudinal axis G and includes opposite exterior side walls 530 and 532. A plurality of interior walls 534 divide the interior of the housing 524 into a plurality of compartments or wells 538, each of which may hold a pair of electrical contacts 540 as shown in the lower compartments 538. The compartments 538 are arranged about the longitudinal axis G. The interior walls 534 extend toward the mating end 514 sufficiently to enclose the contacts 540. The interior walls 534 are also formed from a conductive material and thereby act as shielding members that shield each pair of electrical contacts 540 from adjacent pairs of contacts 540. In an exemplary embodiment, the interior walls 534 are integrally formed with the housing 524. The compartments 538 have beveled interior corners 544 that are provided assure proper orientation of mating plugs, particularly one wire pair and two wire pair plugs.

A keying element 548 is formed on the exterior side wall 530 and is configured to be received in a keying receptacle on the four pair plug 502 (FIG. 12) to assure proper orientation of the four pair plug 502 with respect to the housing 524. A grounding clip 552 is attached to each exterior side wall 530 and 532. The grounding clips 552 include grounding arms 554. The grounding clips 552 are positioned on the side walls 530 and 532 such that a grounding arm 554 extends into each compartment 538. The grounding clips 552 are configured to engage a conductive exterior surface of a mating plug such as the plug 502 to insure a ground connection between the jack 504 and plug 502 when mated, or when one pair or two pair plugs are mated to the jack 504. The jack 504 is also provided with a latch 560 to lock the jack 504 to a face plate (not shown).

Figure 14:
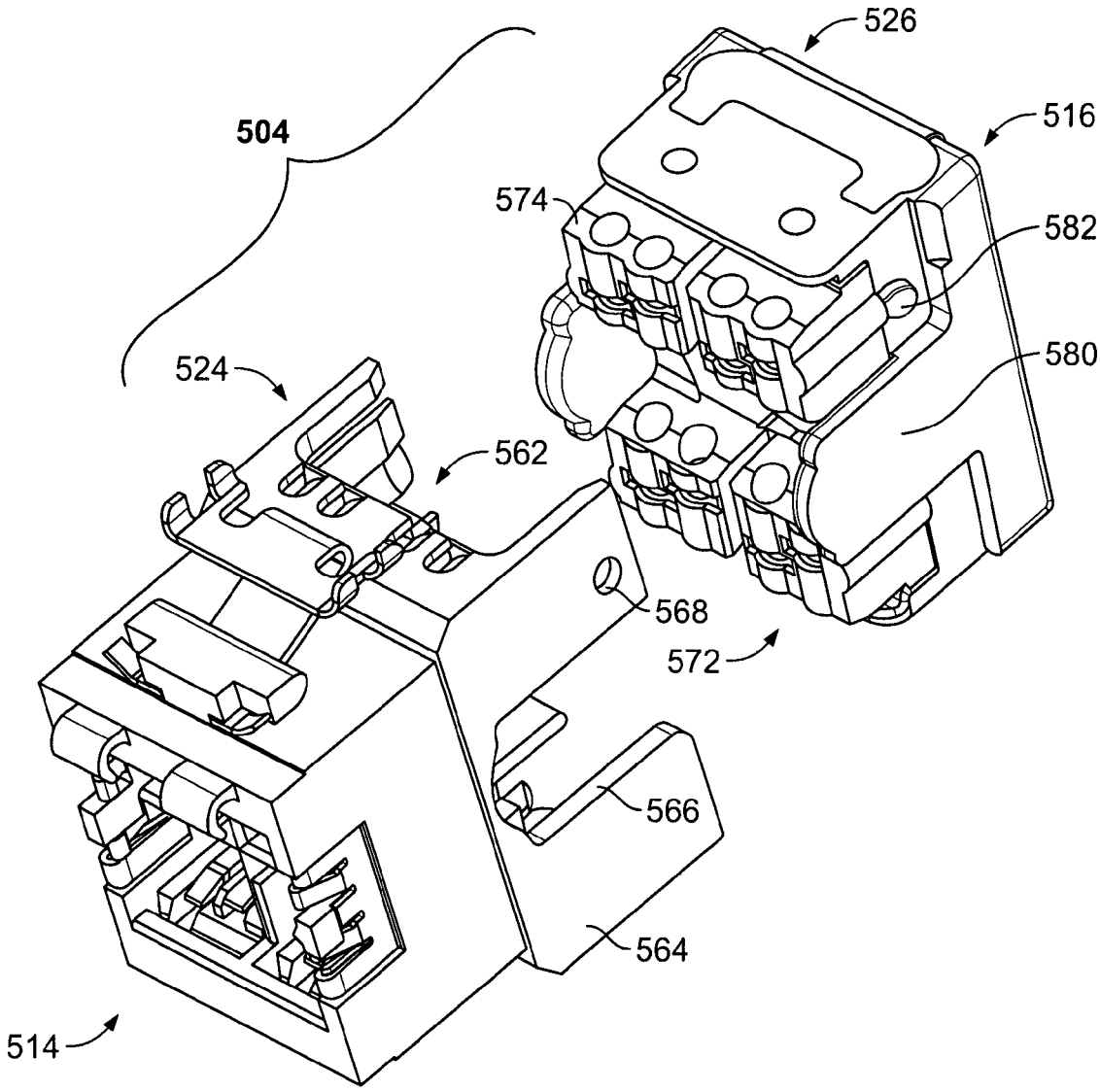
FIG. 14 is a perspective view of jack shown in FIG. 13 with the housing separated from the end cap.

FIG. 14 illustrates a perspective view of the jack 504 with the housing 524 separated from the end cap 526. The housing 524 includes a rearward wire receiving end 562 opposite the mating end 514. Rear side panels 564 include guide slots 566. Apertures 568 are provided for attachment of the end cap 526 to the housing 524. The end cap 526 includes a forward end 572 that is configured to join with the rearward end 562 of the housing.

The end cap 526 includes the wire receiving end 516. An organizer or wire manager 574 is located at the forward end 572 of the end cap 526. The organizer 574 receives wires conveyed through the wire receiving end 516 as will be described. The end cap 526 includes side arms 580 that are received in the guide slots 566 in the housing 524 to position and align the end cap 526 with respect to the housing 524 when the end cap 526 is joined to the housing 524. Protrusions 582 on the end cap 526 are received in the apertures 568 on the housing 524 to lock the end cap 526 and housing 524 together.

Figure 15:
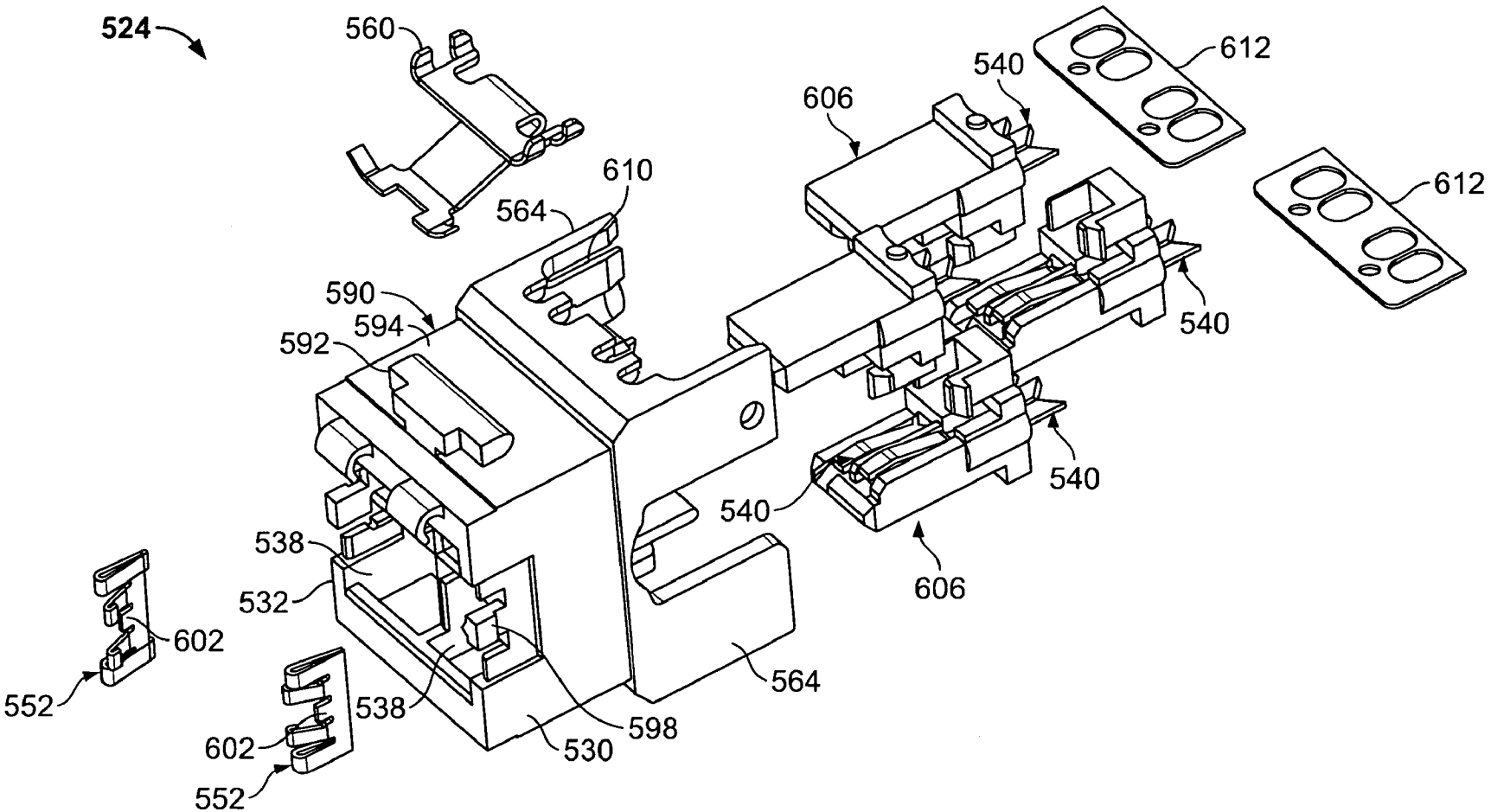
FIG. 15 is an exploded view of the housing shown in FIG. 14.

FIG. 15 is an exploded view of the housing 524. The housing 524 includes a main body 590. A mounting lug 592 is formed on an upper surface 594 of the body 590 to mount the latch 560. Each side wall 530 and 532 includes a notch 598 that receives a tab 602 on the grounding clips 552 for attachment of the grounding clips 552 to the side walls 530 and 532. The contacts 540 are held in contact inserts 606 that are received in the compartments 538 in the housing body 590. The rear side panels 564 include slots 610 (only one of which is visible in FIG. 15) that are sized to receive wire cutters 612. The wire cutters 612 trim the signal wires (not shown) when the housing 524 is joined to the end cap 526 (FIG. 14).

Figure 16:
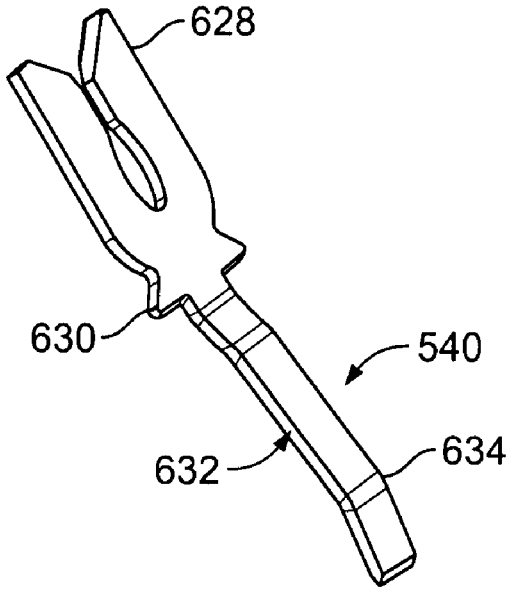
FIG. 16 is a perspective view of a contact insert with contacts.
Figure 16:
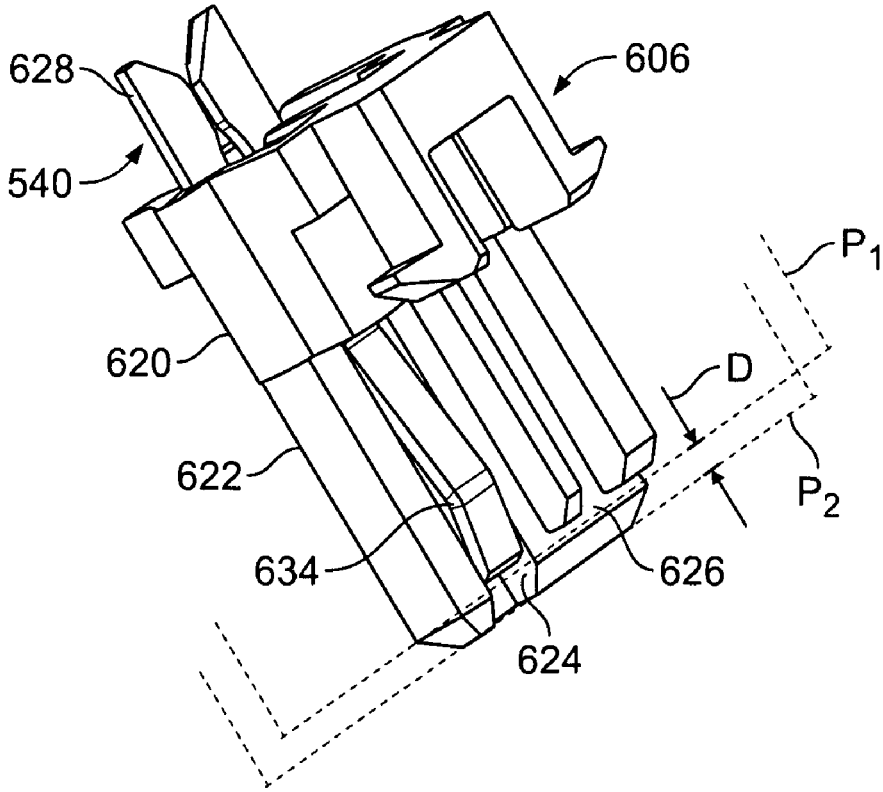

FIG. 16 is a perspective view of the contact insert 606 with contacts 540. The contact insert 606 has a rearward end 620 and a forward end 622. The rearward end 620 is configured to be retained in the housing compartment 538 (FIG. 15). Each contact insert 606 holds a pair of contacts 540 that are inserted into the contact insert 606 through the rearward end 620. The forward end 622 includes a pair of beam guides 624, 626. The contact insert 606 is fabricated from a specific dielectric material selected to provide desired electrical performance in each signal pair in the assembly 500. In an exemplary embodiment, the contact insert is fabricated from a polycarbonate material commonly known as Lexan® 920 and having a dielectric constant of 2.7.

The contact 540 includes a termination end 628, a retention barb 630, and a flexible beam 632. In the illustrated embodiment, the termination end 628 is an insulation displacement contact (IDC) design configured to provide an insulation displacement termination with a signal wire. In alternative embodiments, the contact 540 may be provided with an insulation piercing contact (IPC) termination end. The retention barb 630 engages the contact insert material to retain the contact 540 in the contact insert 606. The flexible beam 632 engages a mating contact (not shown) when the jack 504 is mated with the plug 502 (FIG. 12). The flexible beams 632 includes bends 634 that raise a portion of the beams 632 from the beam guides 624, 626 to allow the beams 632 to flex when engaging the mating contacts. Beam guide 624 lies in a first plane $P_1$ while beam guide 626 lies in a second plane $P_2$ such that the beam guides 624 and 626 are stepped with respect to one another by a distance D to assure proper orientation of the mating plug 502 (FIG. 12) with the jack 504.

Figure 17:
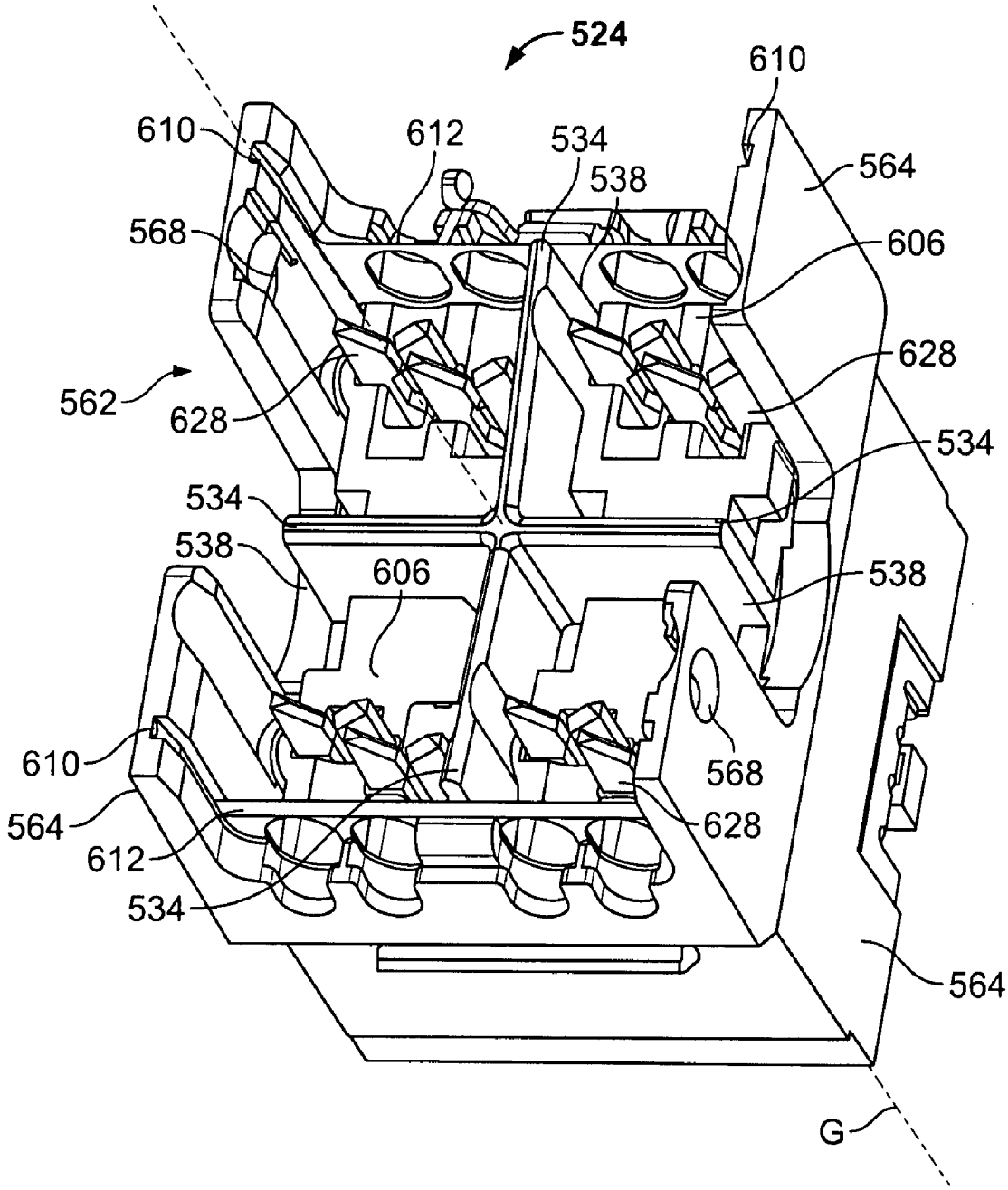
FIG. 17 is a rear perspective view of the housing shown in FIG. 14.

FIG. 17 illustrates a perspective view of the rearward wire receiving end 562 of the housing 524. As illustrated in FIG. 17, the housing is assembled with the contact inserts 606 loaded into the compartments 538 from the rearward end 562 of the housing 524. The interior walls 534 extend through the housing 524 to the rearward end 562 sufficiently to shield the pairs of contact termination ends 628 of the contacts 540 from adjacent pairs of contact termination ends. The wire cutters 612 are received in the slots 610. Apertures 568 are located on diagonally opposite rear side panels 564.

Figure 18:
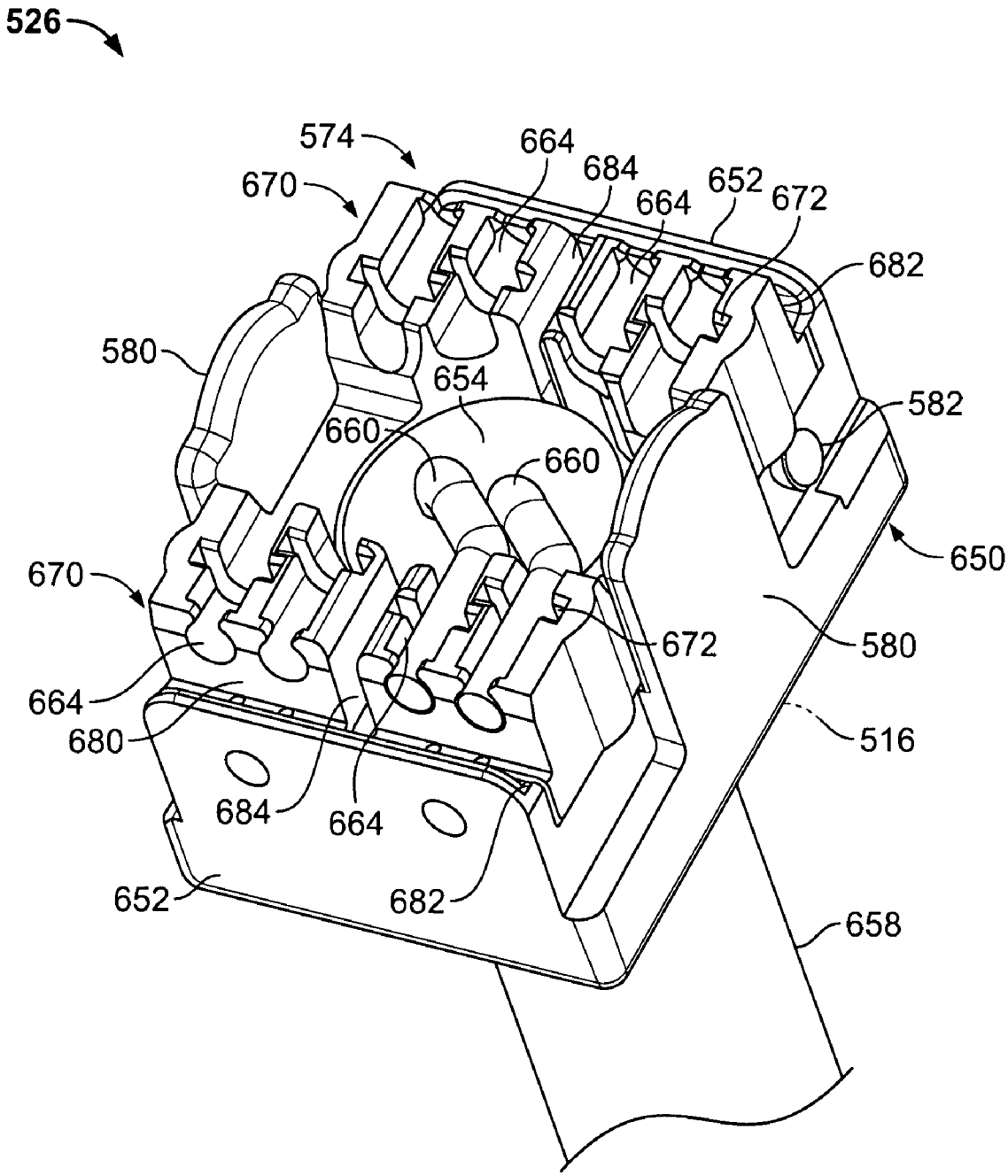
FIG. 18 is a perspective view of the end cap shown in FIG. 14.

FIG. 18 illustrates a perspective view of the end cap 526. The end cap 526 includes a conductive base 650 at the wire receiving end 516 that includes the side arms 580 and end panels 652. In one embodiment, the base 650 is fabricated from a die cast metal. An opening 654 through the base 650 is sized to receive a cable 658 carrying pairs of individually insulated conductors or wires 660. The end cap 526 provides a strain relief and a ground connection to the cable shielding according to known methods. The organizer 574 is positioned on the base 650 such that the opening 654 extends through the organizer 574. The organizer 574 is fabricated from a dielectric material and includes a plurality of wire guides 664, each of which is configured to receive an individual insulated wire 660. The wire guides 664 are arranged in two banks or rows 670 on opposite sides of the opening 654 and are positioned to align with the termination ends 628 of the contacts 540 (FIG. 17). Wire dress openings 672 are formed in the organizer 574 and extend through the wire guides 664.

In the illustrated embodiment, the wire dress openings 672 comprise transverse slots across the wire guides 664. In other embodiments, the wire dress openings 672 may take any shape that is complementary to the geometry of the termination ends 628 of the contacts 540. In some embodiments, the wire guides 664 may comprise tubular channels through the organizer 574. Further, the organizer 574 may be configured to partially obstruct the opening 654 to thereby provide a cable stop that limits the extension of the cable 658 into the opening 654. The organizer 574 is designed to minimize untwisting of the wires 660 so as to minimize the introduction of any undesired electrical properties in the jack 504 (FIG. 12).

When the end cap 526 is joined to the housing 524 (FIG. 17) the protrusions 582 are received in the apertures 568 to lock the end cap 526 and the housing 524 together. The termination ends 628 of the contacts 540 are received in the wire dress openings 672 to electrically terminate the contacts 540 to the wires 660. The wire cutters 612 slide past outer surfaces 680 of the organizer 574 to trim the wires 660 in the wire guides 664. A slot 682 receives an edge of the wire cutters 612. Slots 684 are provided in the organizer 574 to receive rearward ends of the interior walls 534 (FIG. 17) and thereby provide shielding of the connection of the wires 660 to the termination ends 628 (FIG. 17) of the contacts 540. More specifically, when the end cap 526 is joined to the housing 524, the rearward ends of the interior walls 534 shield pairs of wire guides 664 from adjacent pairs of wire guides 664.

Figure 19:
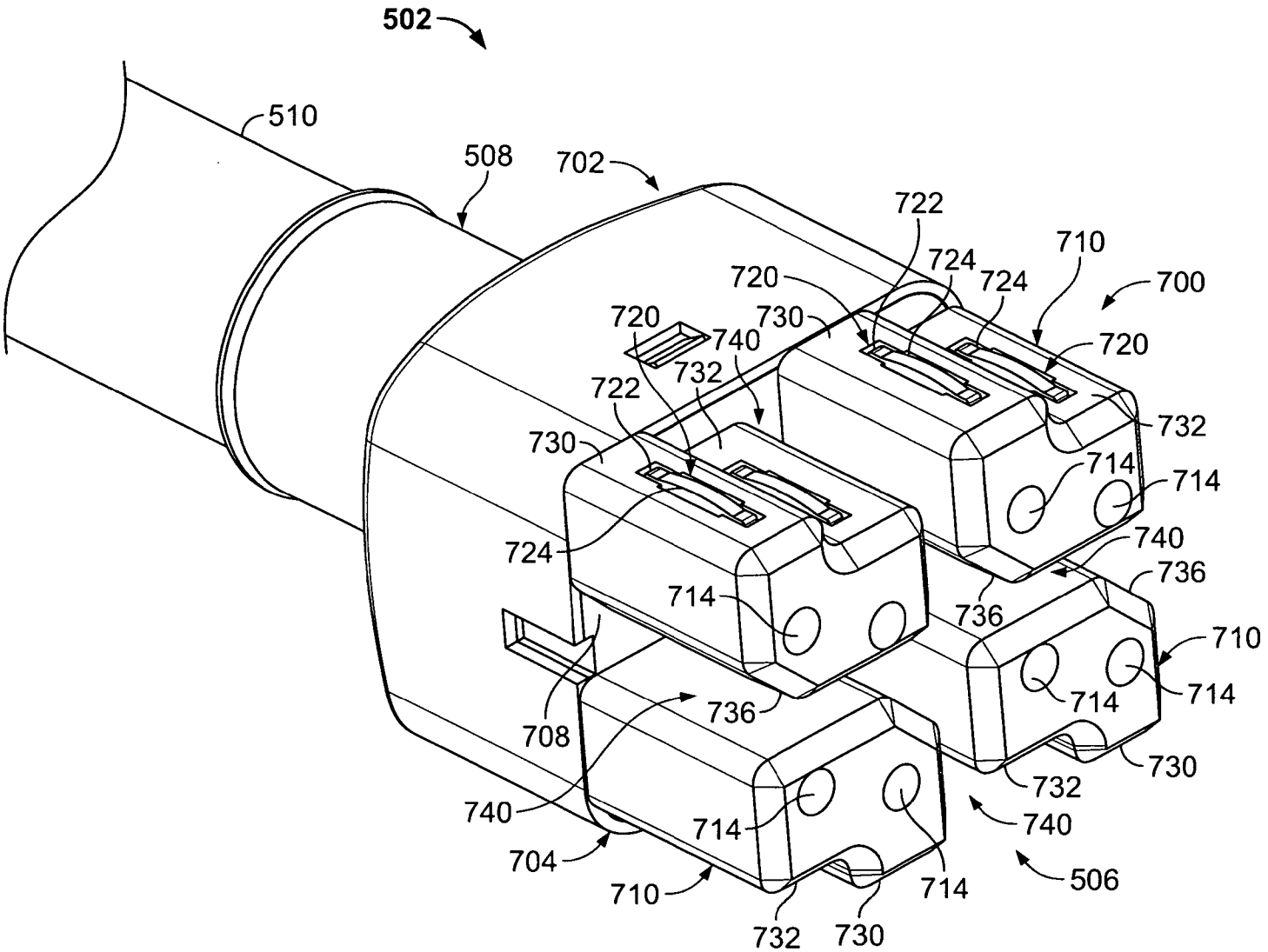
FIG. 19 is a perspective view of the plug connector shown in FIG. 1.

FIG. 19 illustrates a perspective view of the four pair plug connector 502. The plug connector 502 includes a dielectric housing 700 and an end cap 702. The end cap 702 includes a forward end 704 that receives the housing 700 and the wire receiving end 508 that receives the cable 510. The wire receiving end 508 includes strain relief features according to known methods. The one embodiment, the end cap 702 is fabricated from a conductive material such as sheet metal. In alternative embodiments, the end cap may be fabricated from die cast metal.

The plug housing 700 includes the plug mating end 506 and a base 708 that is received in the end cap 702. A plurality of plug guides 710 extend from the base 708 to the mating end 506. A pair of wire passageways 714 extends through each plug guide 710 and the base 708. An individual wire (not shown) is received into each passageway 714. Each plug guide 710 holds a pair of contacts 720. The contacts 720 are received in contact termination slots 722 for termination to the wires in the passageways. The contacts 720 include mating edges 724 that remain exposed after termination to engage the contact beams 632 (FIG. 16) in the jack 504 (FIG. 13) when the plug 502 and jack 504 are mated. The plug guides 710 are configured to be received in the compartments 538 from the mating end 514 of the jack 504 (FIG. 13).

The plug guides 710 are formed with contact surfaces 730 and 732 that are stepped with respect to one another. For the contact pair in each plug guide 710, one contact 720 is inserted into a termination slot 722 in each surface 730, 732. The stepped contact surfaces 730, 732 are complementary to the stepped beam guides 624, 626 in the jack 504 (FIG. 13) to facilitate mating of the plug contacts 720 with the contact beams 632 of the jack contacts 540. The stepped contact surfaces 730, 732 impart an L shape to the plug guides 710. Each plug guide 710 has a beveled corner 736 that is complementary to the beveled interior corners 544 of the contact compartments 538 of the jack 504 (FIG. 13). The plug guides 710 are spaced apart to define clearance channels 740 that receive interior walls 534 of the jack 504 so that the plug guides 710 of the plug 502 are shielded when the plug 502 is mated to the jack 504. Thus, with shielding for the plug guides 710 being provided in the jack 504, the expense and complexity of providing independent shielding of the plug guides 710 in the plug 502 is avoided.

Figure 20:
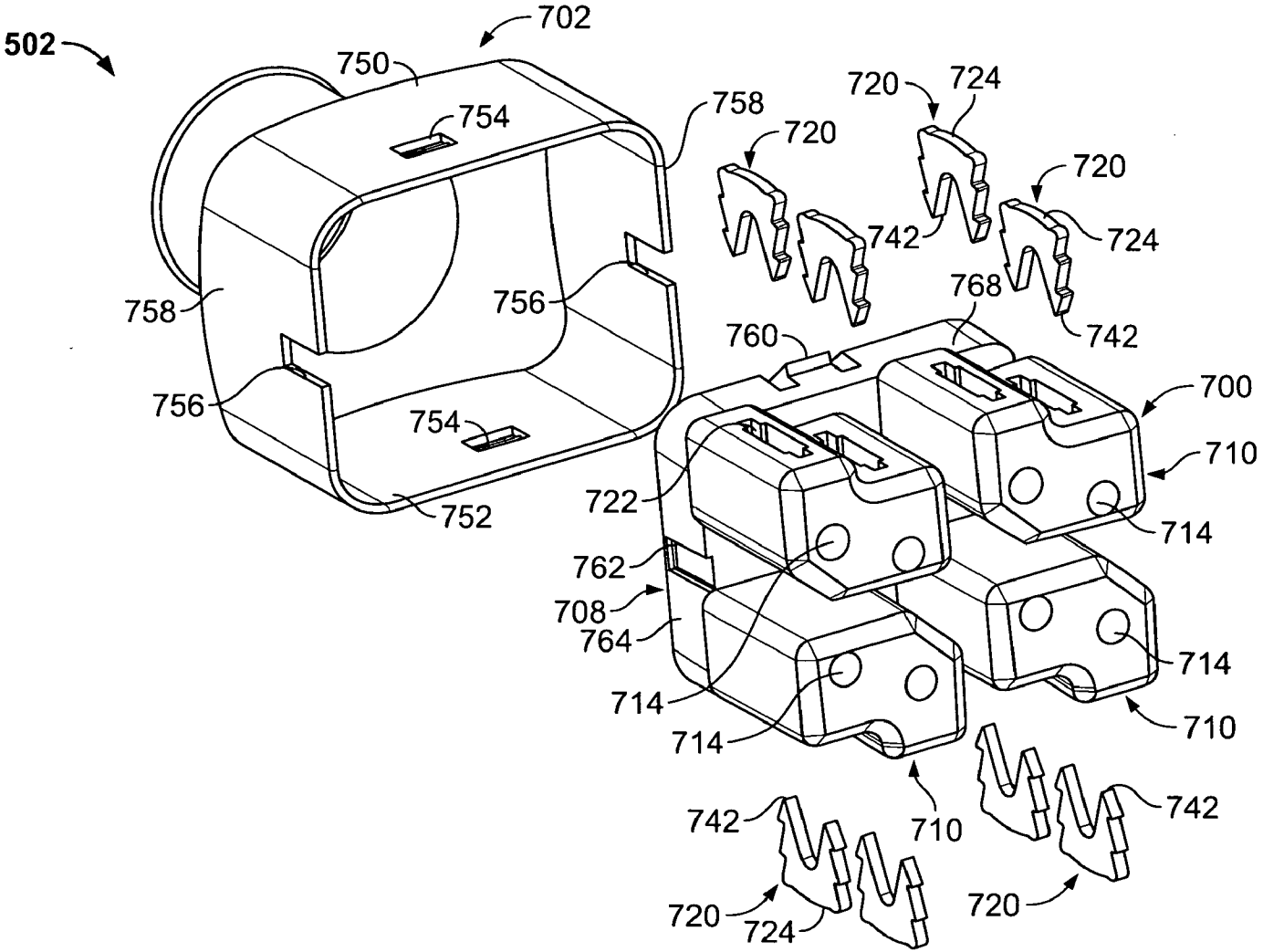
FIG. 20 is an exploded view of the plug connector shown in FIG. 19.

FIG. 20 is an exploded view of the plug connector 502. Each termination slot 722 in the plug guides 710 receives a contact 720. The contacts 720 are insulation piercing contacts that include contact tips 742 that pierce the insulation of wires (not shown) placed in the passageways 714 to electrically engage the wires therein to thereby terminate the contacts 720 to the wires.

The end cap 702 includes an upper panel 750 and a lower panel 752, each of which includes a latch receptacle 754. Orientation slots 756 are formed in opposite sides 758. Latch elements 760 on the housing base 708 (only one of which is visible in FIG. 20) are received in the latch receptacles 754 on the end cap 702 to lock the housing 700 and end cap 702 together. The housing base 708 includes an orientation recess 762 on one side 764 and a protrusion 766 (see FIG. 21) on an opposite side 768. When the housing 700 is joined to the end cap 702, the recess 762 is aligned with the slot 756 in the end cap 702 to form a keying receptacle on the plug 502. The protrusion 766 is received in the slot 756. Thus joined, the keying element 548 (FIG. 13) formed on the side wall 530 of the jack 504 (FIG. 13) is simultaneously received in the recess 762 in the plug housing 700 and the slot 756 in the end cap 702 to assure proper orientation of the plug 502 with the jack 504. Further, when the plug 502 and jack 504 are mated, the grounding clips 552 engage the end cap 702 to provide a positive ground connection between the plug 502 and the jack 504

Figure 21:
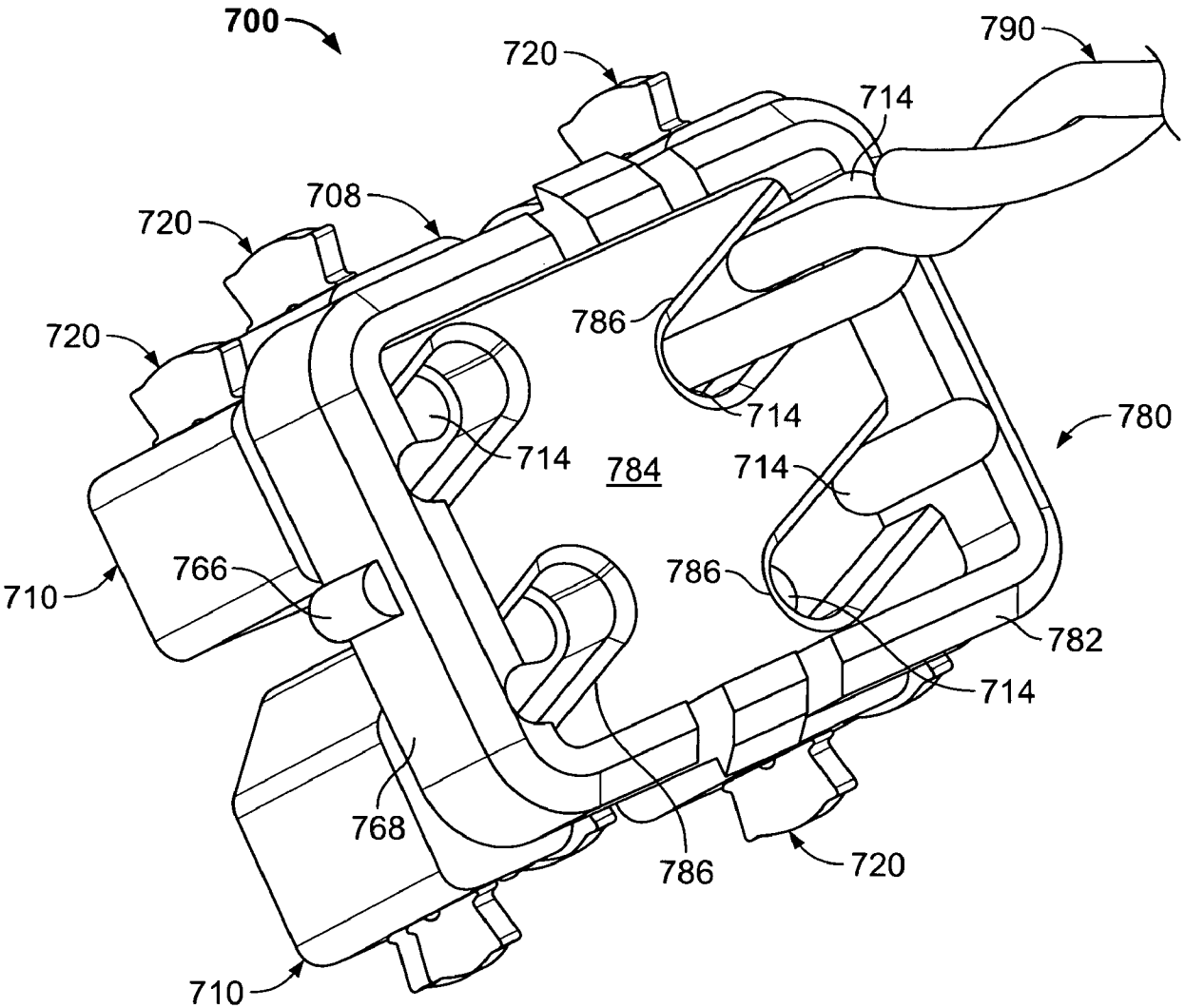
FIG. 21 is a rear perspective view of the plug housing shown in FIG. 20.

FIG. 21 illustrates a perspective view of a rearward end 780 of the plug housing 700, and more particularly, the housing base 708. As illustrated in FIG. 21, the passageways 714 extend from the plug guides 710 through the housing base 708. A sidewall 782 surrounds a floor 784 of the base 708. A recess 786 is formed in the floor 784 for each plug guide 710. More specifically, the wire passageways 714 in each plug guide 710 open into a common recess 786 that also receives a twisted wire pair 790. The provision of the recesses 786 enables the wires of the twisted pair 790 to be fed into the passageways 714 with a minimum of untwisting to thereby minimize the introduction of any undesired electrical properties in the plug 502 (FIG. 19).

The embodiments thus described provide an enhanced connector assembly 500 including a plug 502 and mating jack 504 for transmitting differential signals with a minimum of noise such as cross talk and with a minimum of signal degradation. The jack 504 includes a conductive housing 524 having interior walls 534 that form shielded interior contact compartments 538 holding a contact pair. An organizer 574 includes wire guides 664 for terminating the contacts to signal wires. The interior walls of the housing extend into the organizer to shield pairs of wire guides from adjacent wire guides. The plug includes plug guides 710 that each includes a contact pair. The plug guides are received in the compartments of the jack housing when the plug and jack are mated. The interior walls in the jack housing also shield the plug guides from adjacent plug guides when the plug and jack are mated. No separate shielding is required in the plug for the plug guides which reduces the expense and complexity of the plug. The connector assembly provides enhanced transmission performance including enhanced return loss performance, reduced crosstalk, and reduced alien crosstalk.

While the invention has been described in terms of various specific embodiments, those skilled in the art will recognize that the invention can be practiced with modification within the spirit and scope of the claims.

What is claimed is:

1. An electrical connector comprising:

a conductive housing having a mating end, a wire receiving end, and a longitudinal axis therethrough, said housing holding a plurality of contacts grouped in pairs and arranged about said axis;

at least one shielding member located within said housing, said at least one shielding member isolating each contact pair from an adjacent contact pair; and an organizer positioned on a conductive base that is electrically connected to said housing when the connector is assembled, said organizer being configured for attachment to said wire receiving end of said housing, said organizer defining a central opening that receives a plurality of signal wires, said organizer including a plurality of wire guides arranged about said central opening, each said wire guide receiving one of the signal wires.

2. The connector of claim 1, wherein said at least one shielding member comprises a conductive interior wall of said housing.

3. The connector of claim 1, wherein said plurality of wire guides is arranged in first and second rows on opposite sides of said central opening.

4. The connector of claim 1, wherein said housing includes interior walls, and said housing and said interior walls are fabricated from a conductive material.

5. The connector of claim 1, wherein each said wire guide includes a wire dress opening configured to receive a terminating end of a respective one of said contacts to terminate said contact to a respective wire when said organizer is attached to said housing.

6. The connector of claim 1, further comprising an end cap joined to said wire receiving end of said housing, said end cap including said conductive base holding said organizer.

7. The connector of claim 1, wherein said housing includes a conductive interior wall and said organizer includes a slot sized to receive a rearward end of said interior wall such that pairs of wire guides are shielded from adjacent pairs of wire guides.

8. The connector of claim 1, wherein said housing includes an exterior side wall having a conductive element attached thereto, said conductive element configured to engage a conductive exterior surface on a mating connector to provide a grounding connection between the mating connector and said housing.

9. The connector of claim 1, wherein each contact pair is held in a dielectric insert having a first contact beam guide located in a first plane and a second contact beam guide located in a second plane different from said first plane such that beam portions of the contacts of said contact pair are stepped with respect to one another.

10. The connector of claim 1, wherein said housing includes a beveled interior corner to orient a mating connector to said housing.

11. A connector assembly comprising:

a first connector comprising:

a conductive housing having a mating end and a wire receiving end, said housing including at least one compartment holding a pair of contacts;

at least one shielding member located within said housing, said at least one shielding member isolating said contact pair from an adjacent contact pair; and an organizer positioned on a conductive base that is electrically connected to said housing when the first connector is assembled, said organizer being configured for attachment to said wire receiving end of said housing, said organizer defining a central opening that receives a plurality of signal wires, said organizer including a plurality of wire guides arranged about said central opening, each said wire guides receiving one of the signal wires; and a second connector matable with said first connector, said second connector comprising a dielectric plug housing having a plug guide holding a pair of mating contacts and configured to be received in said at least one compartment, said at least one shielding member shielding said plug guide from an adjacent plug guide when said second connector is mated to said first connector.

12. The connector assembly of claim 11, wherein said plug guide includes stepped contact surfaces that impart an L shape to said guide plug.

13. The connector assembly of claim 11, wherein said plug housing includes a plurality of recesses and each plug guide includes a pair of passageways, and wherein the passageways in each plug guide open into a common one of said plurality of recesses, said common recess receiving a twisted wire pair.

14. The connector assembly of claim 11, wherein said at least one shielding member comprises a conductive interior wall of said housing of said first connector.

15. The connector assembly of claim 11, wherein said first connector housing includes interior walls fabricated from a conductive material.

16. The connector assembly of claim 11, wherein each said wire guide includes a wire dress opening configured to receive a terminating end of a respective one of said contacts to terminate said contact to a respective wire when said organizer is attached to said housing of said first connector.

17. The connector assembly of claim 11, wherein said organizer includes a slot sized to receive a rearward end of said at least one shielding member such that pairs of wire guides are shielded from adjacent pairs of wire guides.

18. The connector assembly of claim 11, wherein said first connector housing includes an exterior side wall having a keying element formed thereon, said keying element being received in a keying receptacle of said second connector to orient the second connector to said first connector.

19. The connector assembly of claim 11, wherein each contact pair in said first connector is held in a dielectric insert having a first contact beam guide located in a first plane and a second contact beam guide located in a second plane different from said first plane such that beam portions of the contacts of said contact pair are stepped with respect to one another.

20. The connector assembly of claim 11, wherein said first connector housing includes an exterior side wall having a conductive element attached thereto, said conductive element configured to engage a conductive exterior surface on said second connector to provide a grounding connection between the first connector and said second connector.

* * * * *

UNITED STATES PATENT AND TRADEMARK OFFICE

CERTIFICATE OF CORRECTION

PATENT NO. : 7,404,739 B2
APPLICATION NO. : 11/707612
DATED : July 29, 2008
INVENTOR(S) : Linda Ellen Shields et al.

It is certified that error appears in the above-identified patent and that said Letters Patent is hereby corrected as shown below:

On the Title Page, Item (75)

Correct spelling of inventor's last name:

(75) Linda Ellen Shields

Signed and Sealed this

Sixteenth Day of June, 2009

JOHN DOLL
*Acting Director of the United States Patent and Trademark Office*